US011565170B2

(12) United States Patent
Hite

(10) Patent No.: US 11,565,170 B2
(45) Date of Patent: Jan. 31, 2023

(54) GAME APPARATUS FOR FACILITATING A GAMEPLAY

(71) Applicant: Jonathan David Hite, Haymarket, VA (US)

(72) Inventor: Jonathan David Hite, Haymarket, VA (US)

( * ) Notice: Subject to any disclaimer, the term of this patent is extended or adjusted under 35 U.S.C. 154(b) by 127 days.

(21) Appl. No.: 17/129,202

(22) Filed: Dec. 21, 2020

(65) Prior Publication Data

US 2021/0187383 A1 Jun. 24, 2021

Related U.S. Application Data

(60) Provisional application No. 62/951,941, filed on Dec. 20, 2019.

(51) Int. Cl.
*A63F 3/00* (2006.01)
*A63F 3/02* (2006.01)

(52) U.S. Cl.
CPC ..... *A63F 3/00533* (2013.01); *A63F 3/00261* (2013.01); *A63F 3/00643* (2013.01); *A63F 3/02* (2013.01); *A63F 2003/00302* (2013.01); *A63F 2003/00662* (2013.01)

(58) Field of Classification Search
CPC ..... A63F 3/00533; A63F 3/00261; A63F 3/00643; A63F 3/02; A63F 2003/00302; A63F 2003/00662; A63F 2003/00287; A63F 2003/00406; A63F 2003/00435; A63F 2003/00646
See application file for complete search history.

(56) References Cited

U.S. PATENT DOCUMENTS 139,425 A * 5/1873 Schindler ..... A63F 3/00895 108/62
3,612,527 A 10/1971 Rogerson
3,741,547 A 6/1973 Zurek
4,348,027 A 9/1982 Escamilla-Kelly
4,546,981 A * 10/1985 Elizondo ..... A63F 3/00261 273/284
5,112,056 A 5/1992 Ching
(Continued)

FOREIGN PATENT DOCUMENTS

RU 185337 U1 11/2018

*Primary Examiner* — Michael D Dennis

(57) ABSTRACT

Disclosed herein is a game apparatus for facilitating a gameplay, in accordance with some embodiments. Accordingly, the game apparatus may include a base member, a support member, and a game board. Further, the support member coupled to the base member. Further, the support member may include a first support member end and a second support member end. Further, the first support member end may be attached to the base member. Further, the support member may be configured for extending between positions in relation to the base member. Further, the game board may be rotatably coupled with the second support member end. Further, the game board may be configured for rotating about a board axis between first board positions. Further, the support member may be configured for elevating the game board to board positions in relation to the surface based on the extending of the support member between the positions.

14 Claims, 23 Drawing Sheets

(56) References Cited

U.S. PATENT DOCUMENTS

| | | | | |
|---|---|---|---|---|
| 5,244,212 | A * | 9/1993 | Bendit | A63F 3/02 273/285 |
| 10,300,367 | B1 * | 5/2019 | Douglas, Jr. | A63F 3/00694 |
| 2005/0077678 | A1 * | 4/2005 | Bibi | A63F 3/00895 273/284 |
| 2005/0104291 | A1 * | 5/2005 | Levinson | A63F 3/00097 273/258 |
| 2009/0322026 | A1 * | 12/2009 | Sun | A63F 3/02 273/238 |
| 2018/0178113 | A1 * | 6/2018 | Knippen | A63F 3/02 |

* cited by examiner

GAME APPARATUS FOR FACILITATING A GAMEPLAY

The current application claims a priority to the U.S. Provisional Patent application Ser. No. 62/951,941 filed on Dec. 20, 2019. The current application is filed on Dec. 21, 2020 while Dec. 20, 2020 was on a weekend.

FIELD OF THE INVENTION

Generally, the present disclosure relates to the field of amusement devices: games. More specifically, the present disclosure relates to a game apparatus for facilitating a gameplay.

BACKGROUND OF THE INVENTION

Existing game apparatuses for facilitating a gameplay are deficient with regard to several aspects. For instance, current game apparatuses do not allow players to adjust the height of a playing board. Furthermore, current game apparatuses do not allow players to simultaneously play on a top and bottom surface of a single playing board. Moreover, current game apparatuses do not allow a player to adjust the orientation of a playing board.

Therefore, there is a need for improved game apparatus for facilitating a gameplay that may overcome one or more of the above-mentioned problems and/or limitations.

SUMMARY OF THE INVENTION

This summary is provided to introduce a selection of concepts in a simplified form, that are further described below in the Detailed Description. This summary is not intended to identify key features or essential features of the claimed subject matter. Nor is this summary intended to be used to limit the claimed subject matter's scope.

Disclosed herein is a game apparatus for facilitating a gameplay, in accordance with some embodiments. Accordingly, the game apparatus may include a base member, at least one support member, and a game board. Further, the base member may be disposable on at least one surface. Further, the at least one support member coupled to the base member. Further, a support member of the at least one support member may include a first support member end and a second support member end. Further, the first support member end may be attached to the base member. Further, the at least one support member may be configured for extending between a plurality of positions in relation to the base member. Further, the game board may be rotatably coupled with the second support member end. Further, the game board may be configured for rotating about a board axis between a plurality of first board positions. Further, the board axis may be parallel to the base member. Further, the at least one support member may be configured for elevating the game board to a plurality of board positions in relation to the at least one surface based on the extending of the at least one support member between the plurality of positions. Further, the game board facilitates the gameplay based on the elevating and the rotating.

Further disclosed herein is a game apparatus for facilitating a gameplay, in accordance with some embodiments. Accordingly, the game apparatus may include a base member, at least one support member, and a game board. Further, the base member may be disposable on at least one surface. Further, the at least one support member coupled to the base member. Further, a support member of the at least one support member may include a first support member end and a second support member end. Further, the first support member end may be attached to the base member. Further, the at least one support member may be configured for extending between a plurality of positions in relation to the base member. Further, the game board may be rotatably coupled with the second support member end. Further, the game board may be configured for rotating about a board axis between a plurality of first board positions. Further, the board axis may be parallel to the base member. Further, the at least one support member may be configured for elevating the game board to a plurality of board positions in relation to the at least one surface based on the extending of the at least one support member between the plurality of positions. Further, the game board facilitates the gameplay based on the elevating and the rotating. Further, the game board may include a top game board surface and a bottom game board surface. Further, the game board facilitates the gameplay on at least one of the top game board surface and the bottom game board surface based on the elevating and the rotating.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and subcombinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the applicants. The applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

DETAIL DESCRIPTIONS OF THE INVENTION

Figure 1:
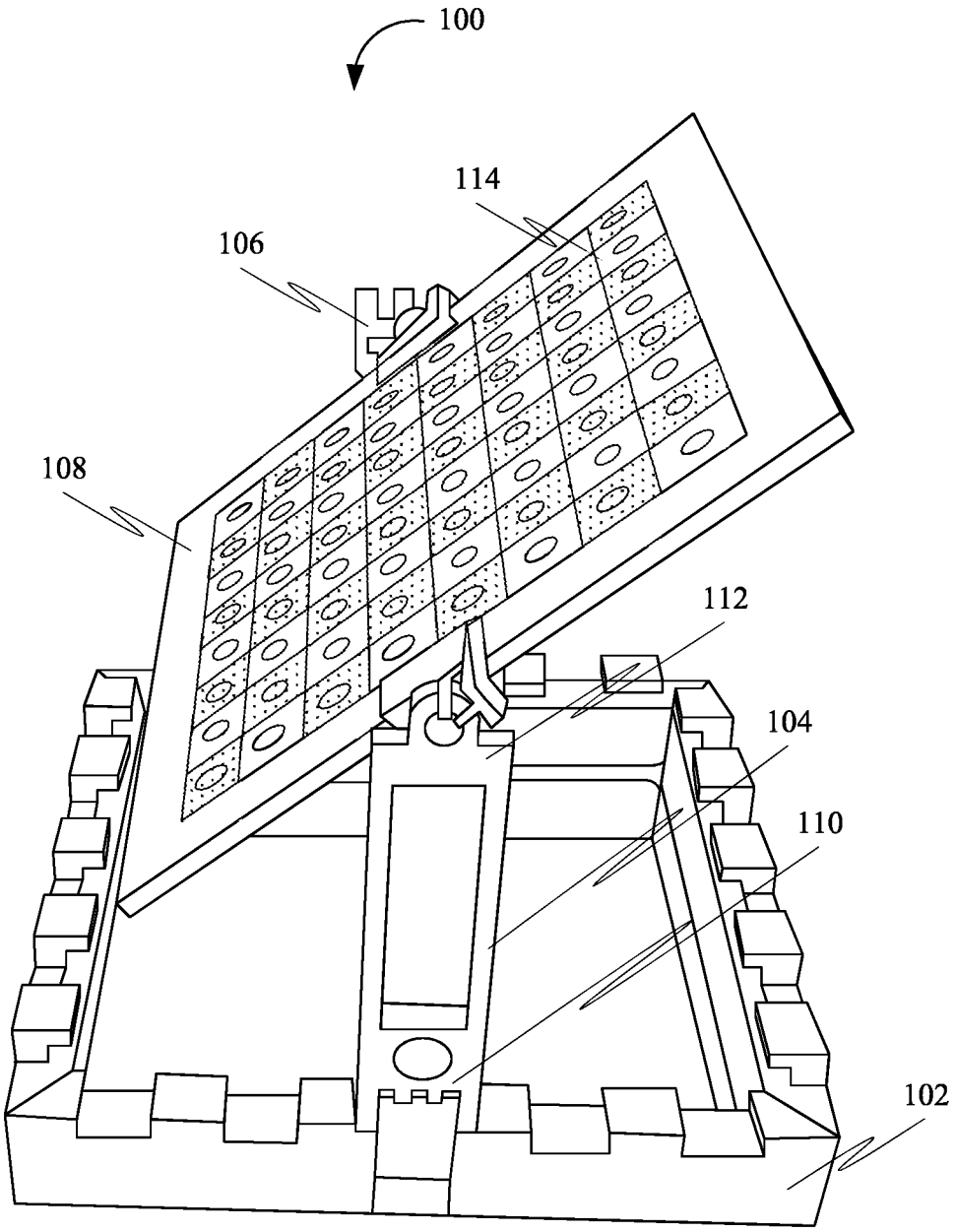
FIG. 1 is a top side perspective view of a game apparatus for facilitating a gameplay, in accordance with some embodiments.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim limitation found herein and/or issuing here from that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the claims found herein and/or issuing here from. The present disclosure contains headers. It should be understood that these headers are used as references and are not to be construed as limiting upon the subjected matter disclosed under the header.

The present disclosure includes many aspects and features. Moreover, while many aspects and features relate to, and are described in the context of a game apparatus for facilitating a gameplay, embodiments of the present disclosure are not limited to use only in this context.

In general, the method disclosed herein may be performed by one or more computing devices. For example, in some embodiments, the method may be performed by a server computer in communication with one or more client devices over a communication network such as, for example, the Internet. In some other embodiments, the method may be performed by one or more of at least one server computer, at least one client device, at least one network device, at least one sensor and at least one actuator. Examples of the one or more client devices and/or the server computer may include, a desktop computer, a laptop computer, a tablet computer, a personal digital assistant, a portable electronic device, a wearable computer, a smart phone, an Internet of Things (IoT) device, a smart electrical appliance, a video game console, a rack server, a super-computer, a mainframe computer, mini-computer, micro-computer, a storage server, an application server (e.g. a mail server, a web server, a real-time communication server, an FTP server, a virtual server, a proxy server, a DNS server etc.), a quantum computer, and so on. Further, one or more client devices and/or the server computer may be configured for executing a software application such as, for example, but not limited to, an operating system (e.g. Windows, Mac OS, Unix, Linux, Android, etc.) in order to provide a user interface (e.g. GUI, touch-screen based interface, voice based interface, gesture based interface etc.) for use by the one or more users and/or a network interface for communicating with other devices over a communication network. Accordingly, the server computer may include a processing device configured for performing data processing tasks such as, for example, but not limited to, analyzing, identifying, determining, generating, transforming, calculating, computing, compressing, decompressing, encrypting, decrypting, scrambling, splitting, merging, interpolating, extrapolating, redacting, anonymizing, encoding and decoding. Further, the server computer may include a communication device configured for communicating with one or more external devices. The one or more external devices may include, for example, but are not limited to, a client device, a third party database, public database, a private database and so on. Further, the communication device may be configured for communicating with the one or more external devices over one or more communication channels. Further, the one or more communication channels may include a wireless communication channel and/or a wired communication channel. Accordingly, the communication device may be configured for performing one or more of transmitting and receiving of information in electronic form. Further, the server computer may include a storage device configured for performing data storage and/or data retrieval operations. In general, the storage device may be configured for providing reliable storage of digital information. Accordingly, in some embodiments, the storage device may be based on technologies such as, but not limited to, data compression, data backup, data redundancy, deduplication, error correction, data fingerprinting, role based access control, and so on.

Further, one or more steps of the method disclosed herein may be initiated, maintained, controlled and/or terminated based on a control input received from one or more devices operated by one or more users such as, for example, but not limited to, an end user, an admin, a service provider, a service consumer, an agent, a broker and a representative thereof. Further, the user as defined herein may refer to a human, an animal or an artificially intelligent being in any state of existence, unless stated otherwise, elsewhere in the present disclosure. Further, in some embodiments, the one or more users may be required to successfully perform authentication in order for the control input to be effective. In general, a user of the one or more users may perform authentication based on the possession of a secret human readable secret data (e.g. username, password, passphrase, PIN, secret question, secret answer etc.) and/or possession of a machine readable secret data (e.g. encryption key, decryption key, bar codes, etc.) and/or or possession of one or more embodied characteristics unique to the user (e.g. biometric variables such as, but not limited to, fingerprint, palm-print, voice characteristics, behavioral characteristics, facial features, iris pattern, heart rate variability, evoked potentials, brain waves, and so on) and/or possession of a unique device (e.g. a device with a unique physical and/or chemical and/or biological characteristic, a hardware device with a unique serial number, a network device with a unique IP/MAC address, a telephone with a unique phone number, a smartcard with an authentication token stored thereupon, etc.). Accordingly, the one or more steps of the method may include communicating (e.g. transmitting and/or receiving) with one or more sensor devices and/or one or more actuators in order to perform authentication. For example, the one or more steps may include receiving, using the communication device, the secret human readable data from an input device such as, for example, a keyboard, a keypad, a touch-screen, a microphone, a camera and so on. Likewise, the one or more steps may include receiving, using the communication device, the one or more embodied characteristics from one or more biometric sensors.

Further, one or more steps of the method may be automatically initiated, maintained and/or terminated based on one or more predefined conditions. In an instance, the one or more predefined conditions may be based on one or more contextual variables. In general, the one or more contextual variables may represent a condition relevant to the performance of the one or more steps of the method. The one or more contextual variables may include, for example, but are not limited to, location, time, identity of a user associated with a device (e.g. the server computer, a client device etc.) corresponding to the performance of the one or more steps, environmental variables (e.g. temperature, humidity, pressure, wind speed, lighting, sound, etc.) associated with a device corresponding to the performance of the one or more steps, physical state and/or physiological state and/or psychological state of the user, physical state (e.g. motion, direction of motion, orientation, speed, velocity, acceleration, trajectory, etc.) of the device corresponding to the performance of the one or more steps and/or semantic content of data associated with the one or more users. Accordingly, the one or more steps may include communicating with one or more sensors and/or one or more actuators associated with the one or more contextual variables. For example, the one or more sensors may include, but are not limited to, a timing device (e.g. a real-time clock), a location sensor (e.g. a GPS receiver, a GLONASS receiver, an indoor location sensor etc.), a biometric sensor (e.g. a fingerprint sensor), an environmental variable sensor (e.g. temperature sensor, humidity sensor, pressure sensor, etc.) and a device state sensor (e.g. a power sensor, a voltage/current sensor, a switch-state sensor, a usage sensor, etc. associated with the device corresponding to performance of the or more steps).

Further, the one or more steps of the method may be performed one or more number of times. Additionally, the one or more steps may be performed in any order other than as exemplarily disclosed herein, unless explicitly stated otherwise, elsewhere in the present disclosure. Further, two or more steps of the one or more steps may, in some embodiments, be simultaneously performed, at least in part.

Further, in some embodiments, there may be one or more time gaps between performance of any two steps of the one or more steps.

Further, in some embodiments, the one or more predefined conditions may be specified by the one or more users. Accordingly, the one or more steps may include receiving, using the communication device, the one or more predefined conditions from one or more and devices operated by the one or more users. Further, the one or more predefined conditions may be stored in the storage device. Alternatively, and/or additionally, in some embodiments, the one or more predefined conditions may be automatically determined, using the processing device, based on historical data corresponding to performance of the one or more steps. For example, the historical data may be collected, using the storage device, from a plurality of instances of performance of the method. Such historical data may include performance actions (e.g. initiating, maintaining, interrupting, terminating, etc.) of the one or more steps and/or the one or more contextual variables associated therewith. Further, machine learning may be performed on the historical data in order to determine the one or more predefined conditions. For instance, machine learning on the historical data may determine a correlation between one or more contextual variables and performance of the one or more steps of the method. Accordingly, the one or more predefined conditions may be generated, using the processing device, based on the correlation.

Overview:

The present disclosure describes a game apparatus for facilitating a gameplay. Further, the game apparatus may include a Hitened Chess apparatus. Further, the Hitened Chess apparatus may include a Castle Box. Further, the Castle Box (CB) may be a chessboard base/storage box designed to look like a castle with notched crenellations (battlements of a castle) atop. Further, three of the walls serve as horizontal rails for a Sticky Board (SB) to slide in and out of; also functioning as the foothold connection for a Tower Support (TS). Further, the Tower Support (TS) may be a model sized castle tower with a specially designed head (eye) that may receive a Pivot Key. Further, the TS may have a specially designed footing that may slide into the base and can lock into place with a free sliding and detachable Shield Lock. Further, the Sticky Board (SB) may be a transparent 8×8 tile Black/Clear chessboard with neodymium magnets embedded and sealed within the center of each tile, allowing chess pieces to magnetize to both sides of the board regardless if right-side-up or inverted. Further, a front wall of the CB may set slightly lower than the other three walls. Low enough for the SB to clear when horizontally inserted; seamlessly sliding into the sidewall crenellations to seal the top of the box closed. Further, the front wall may have a centered, magnetized, and hinged a Drawbridge Turret (DT) that functions as the locking mechanism to lock the SB in place when closed; it also serves as the foothold connection for a Guillotine Support (GS). Further, the Guillotine Support (GS) may be a model sized guillotine with a specially designed top that may receive a Pivot Key. Further, the GS may have specially designed footing that attaches to the base, locking it into place when the free sliding Blade Lock (BL) may be down. Further, enabling the GS to swing open and closed, locking and releasing the SB in/from the heightened position. Further, the CB has a clear bottom so the SB can be placed underneath it, and pieces can be set up and played inside. Additionally, any chessboard print or design can be placed underneath the CB, giving a completely different visual effect. CB variations include but are not limited to:

Anything Themed

Further, the Tower Support (TS) may be a model sized castle tower with a specially designed head (eye) that may receive a Pivot Key. Further, the TS may have a specially designed footing that may slide into the base and can lock into place with a free sliding and detachable Shield Lock.

TS variations include but are not limited to:

Rods, Pillars, Sticks, Towers, Hydraulics.

Anything rigid enough to maintain stability for the SB.

TS material variations include but are not limited to:

Plastic, Wood, Glass, Metal, Alloy, non-Metal, Ceramic, Organic, Magnets, Electronic Circuit Boards.

Further, the Shield Lock (SL) may be a broken shield model with a sword plunged in it. Further, the SL may be used to keep the TS from moving. Further, a specially designed hilt of the sword may act as a clamp for additional stability when the SB is in a vertical position.

SL variations include but are not limited to:

Anything that may lock the TS in place while maintaining stability for the SB.

SL material variations include but are not limited to:

Plastic, Wooden, Glass, Metal, Alloy, non-Metal, Ceramic, Organic, Magnetic, Electronic, Rods.

Further, the Guillotine Support (GS) may be a model sized guillotine with a specially designed top that may receive a Pivot Key. Further, the GS may have specially designed footing that attaches to the base, locking it into place when the free sliding Blade Lock (BL) may be down.

GS variations include but are not limited to:

Plastic, Wooden, Glass, Metal, Alloy, non-Metal, Ceramic, Organic, Magnetic, Electronic, Rods.

Anything rigid enough to maintain stability for the SB

Further, the Blade Lock (BL) may be a model size blade that may fit inside the GS, to lock it onto the Drawbridge Turret (DT). Further, the DT may slide up and down to simulate a real guillotine for executing various captured pieces.

Further, the Sticky Board (SB) may be a transparent 8×8 tile Black/Clear chessboard with neodymium magnets embedded and sealed within the center of each tile, allowing chess pieces to magnetize to both sides of the board regardless if right-side-up or inverted. Further, the Sticky Board may include 3 layers sealed together. Further, top and bottom layers may be rigid, made of transparent material, and are half the thickness of the middle layer. Further, middle layer is a specially designed piece of rigid transparent material with sizable holes for proportionate neodymium disc magnets to fit. Further, dark transparent square tiles fit into the square cutouts within the middle layer to achieve the iconic checkered look.

SB material variations include but are not limited to:

Transparent acrylic and other types of plastic, glass, transparent wood, and other types of wood, or metal.

SB adhesive variations include but are not limited to:

All types of magnets, Velcro, Pins, Threaded bolts, Legos.

Further, the Pivot Key (PK) may be a specially designed pivot clamp that may slot horizontally into the head (eye) atop the TS and the GS. Allowing 180° of movement back and forth.

Further, the PK material includes but are not limited to:

Plastic, Wooden, Glass, Metal, Alloy, non-Metal, Ceramic, Organic, Magnetic

Further, the present disclosure describes the Hitened Chess (HC). Further, HC is an extension of Chess with alternate variations. The premise of HC is to (physically or virtually) elevate a chessboard high enough above the tabletop to utilize the underside as an additional playing field. Once elevated, the chessboard may be manipulated, flipped, tilted, and turned depending on the fabrication.

Elevation variations include but are not limited to:

Castle themed with:

A specially designed miniature Tower, miniature Guillotine, and 2 Pivot Keys

Two (2) specially designed miniature Towers and 2 Pivot Keys

A Goose Neck centered and fastened to the bottom of the chessboard while tethered to the base itself Hydraulics that slowly raise the board to lock into place when pressed Hinged pillars that unfold from within the storage box to act as supports for the chessboard Additional Mechanism Ideas:

Chess pieces that temporarily lock into the board without magnets, designed with a small fan blade like mechanism that intertwines into one another 1. Both towers have a built-in clock that could also second as a locking mechanism 2. A rod that runs through the middle of the SB that slides back and forth, and works in conjunction with the PK's 3. Tiles that light up when occupied by a piece 4. Pieces that light up when another piece is placed underneath 5. Lights wired throughout the board Further, the present disclosure generally relates to games. More specifically, the present disclosure relates to a multiplayer strategy board game. Further, the present disclosure describes a game of chess. Further, chess is a two-player strategy board game played on a checkered board with 64 squares arranged in an 8×8 grid. Further, the present disclosure describes chess game apparatus that allows players to adjust the height of a chessboard. In addition, the chess game apparatus also allows players to simultaneously play on the top and bottom surface of a single 8×8 chessboard. Furthermore, the chess game apparatus also allows a player to adjust the orientation of a chessboard. Moreover, the chess game apparatus also allows a player to play additional Chess variation games on a chessboard. Further, the chess game apparatus may be a Hitened Chess.

FIG. 1 is a top side perspective view of a game apparatus 100 for facilitating a gameplay, in accordance with some embodiments. Further, the game apparatus 100 may include a base member 102, at least one support member 104-106, and a game board 108.

Further, the base member 102 may be disposable on at least one surface.

Further, the at least one support member 104-106 may be coupled to the base member 102. Further, a support member 104 of the at least one support member 104-106 may include a first support member end 110 and a second support member end 112. Further, the first support member end 110 may be attached to the base member 102. Further, the at least one support member 104-106 may be configured for extending between a plurality of positions in relation to the base member 102.

Further, the game board 108 rotatably coupled with the second support member end 112. Further, the game board 108 may be configured for rotating about a board axis between a plurality of first board positions. Further, the plurality of first board positions corresponds to a plurality of orientations of the game board 108 in relation to the at least one surface. Further, the board axis may be parallel to the base member 102. Further, the at least one support member 104-106 may be configured for elevating the game board 108 to a plurality of board positions based on the extending of the at least one support member 104-106 between the plurality of positions. Further, the game board 108 may be elevated to the plurality of board positions in relation to the at least one surface based on the elevating. Further, the game board 108 facilitates the gameplay based on the elevating and the rotating. Further, the game board 108 may include a chessboard associated with a game of chess. Further, the chessboard may include a checkered board with 64 squares arranged in an 8×8 grid.

Figure 2:
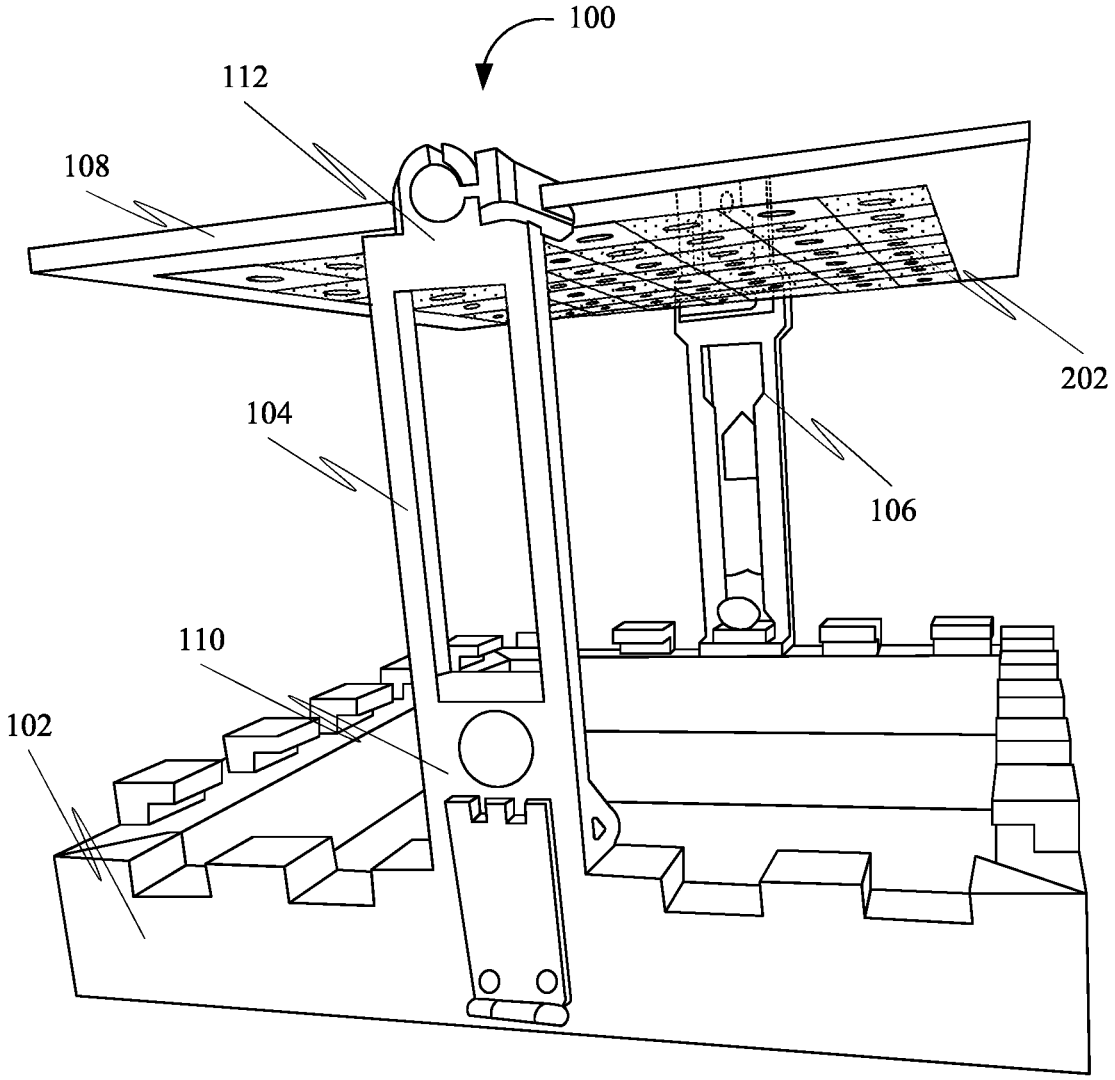
FIG. 2 is a bottom side perspective view of the game apparatus for facilitating the gameplay, in accordance with some embodiments.
Figure 4:
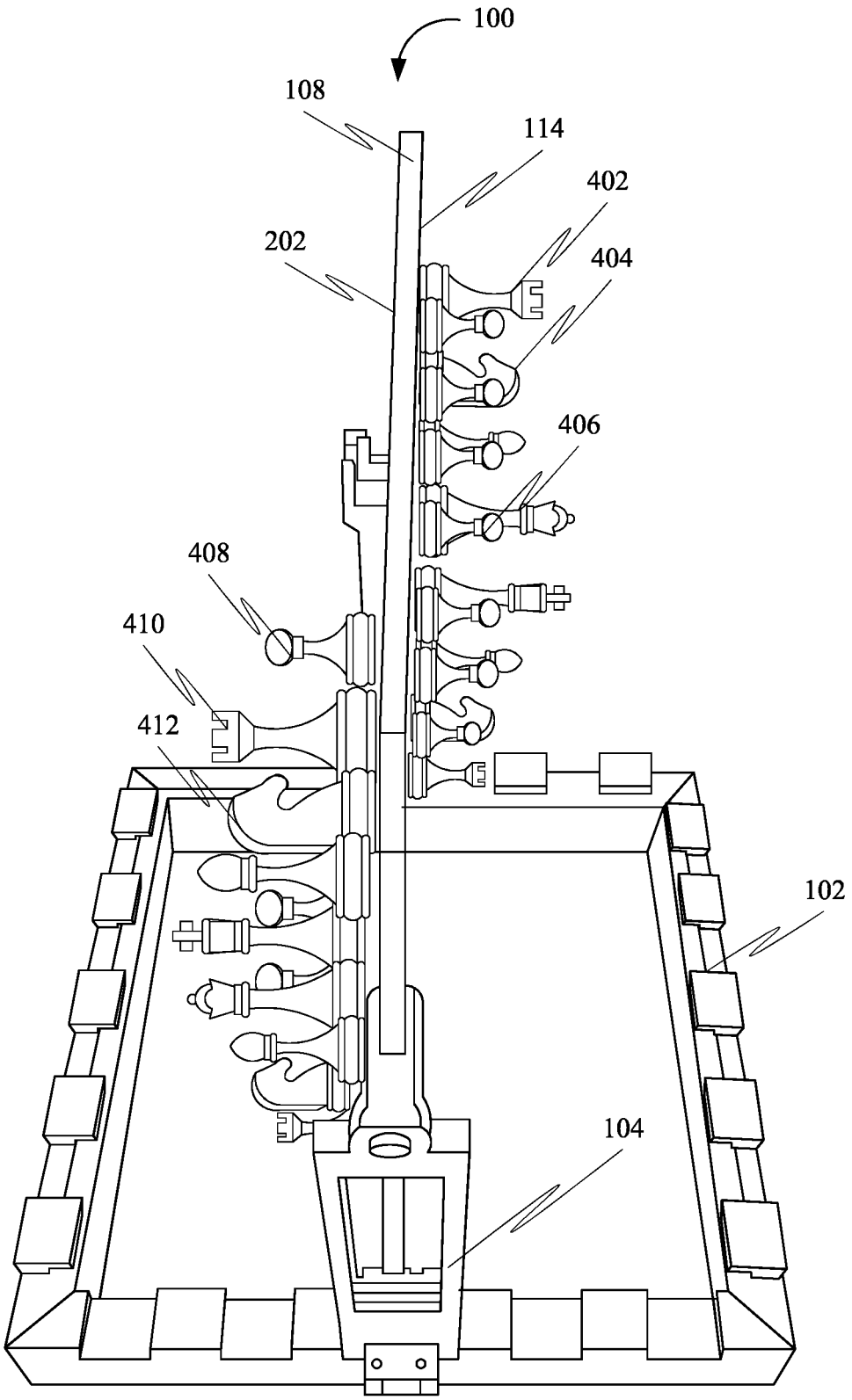
FIG. 4 is a side perspective view of the game apparatus with the plurality of game pieces, in accordance with some embodiments.
Figure 5:
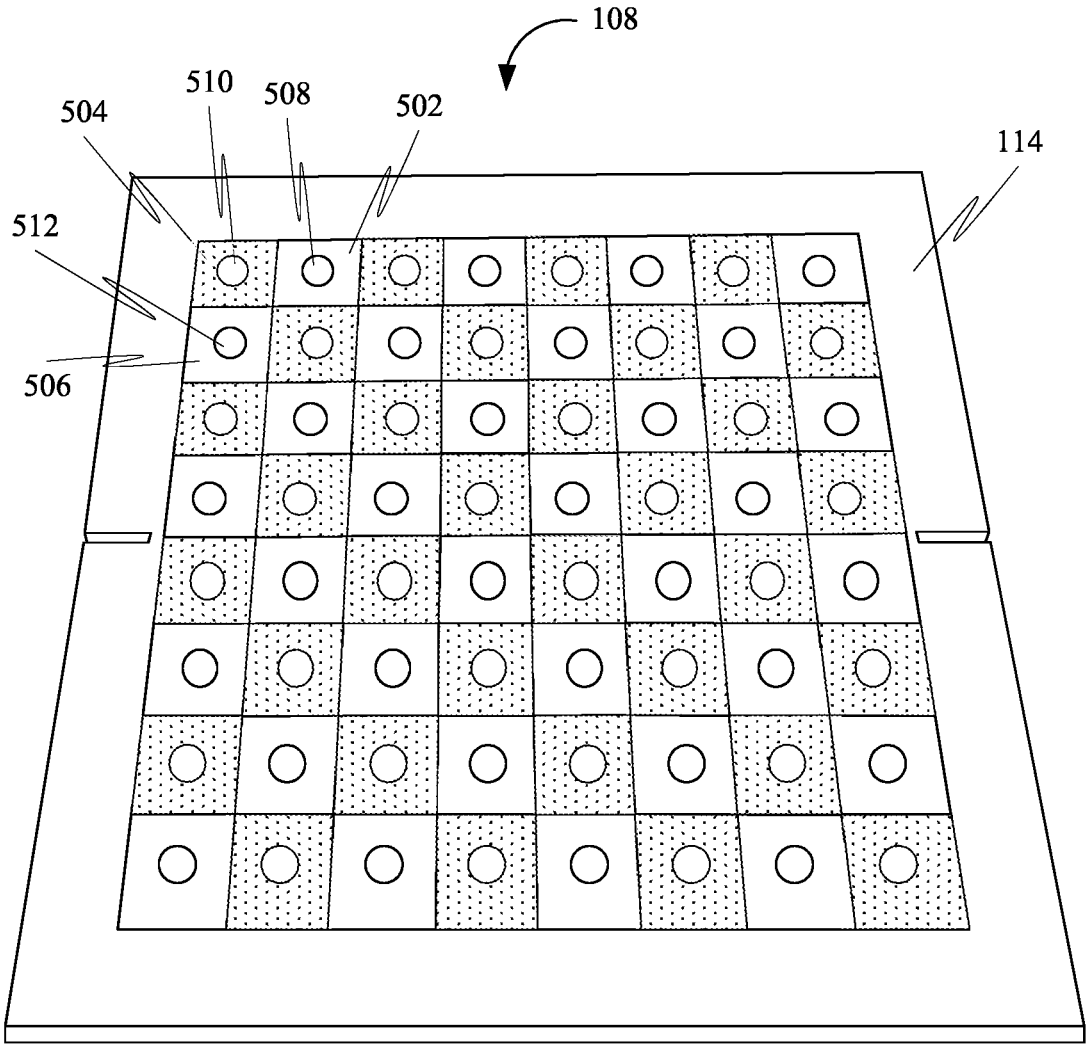
FIG. 5 is a top view of the game board of the game apparatus, in accordance with some embodiments.

Further, in some embodiments, the game board 108 may include a top game board surface 114 and a bottom game board surface 202, as shown in FIG. 2. Further, the game board 108 facilitates the gameplay on at least one of the top game board surface 114 and the bottom game board surface 202 based on the elevating and the rotating. In further embodiments, the game apparatus 100 may include a plurality of game pieces 402-412, as shown in FIG. 4. Further, the plurality of game pieces 402-412 may be configured to be positioned on a plurality of game board surface portions 502-506, as shown in FIG. 5, of the at least one of the top game board surface 114 and the bottom game board surface 202 for facilitating the gameplay. Further, the plurality of game board surface portions 502-506 may include 64 squares arranged in an 8×8 grid. Further, in some embodiments, the game board 108 may include a plurality of adhering elements 508-512, as shown in FIG. 5. Further, the plurality of adhering elements 508-512 may include a plurality of magnets. Further, the plurality of magnets may include a plurality of neodymium magnets. Further, the plurality of adhering elements 508-512 may include Velcro, pins, threaded bolts, etc. Further, the plurality of adhering elements 508-512 may be comprised in the plurality of game board surface portions 502-506. Further, the plurality of adhering elements 508-512 may be configured for attaching the plurality of game pieces 402-412 on the plurality of game board surface portions 502-506 in at least one of the plurality of first board positions and the plurality of board positions. Further, in an embodiment, the plurality of adhering elements 508-512 may be configured for removably attaching the plurality of game pieces 402-412 on the plurality of game board surface portions 502-506 in the at least one of the plurality of first board positions and the plurality of board positions. Further, in an embodiment, an adhering element of the plurality of adhering elements 508-512 may include a first adhering part and a second adhering part. Further, the first adhering part may be comprised in a game board surface portion of the plurality of game board surface portions 502-506. Further, the second adhering part may be comprised in a game piece of the plurality of game pieces 402-412. Further, the first adhering part and the second adhering part may be configured to be detachably attached for detachably attaching the game piece to the game board surface portion. Further, in some embodiments, the plurality of game pieces 402-412 may include a plurality of first adhering elements. Further, the plurality of first adhering elements may include a plurality of magnets. Further, the plurality of magnets may include a plurality of neodymium magnets. Further, the plurality of first adhering elements may be configured for attaching the plurality of game pieces 402-412 to the plurality of game board surface portions 502-506 in at least one of the plurality of first board positions and the plurality of board positions.

Figure 6:
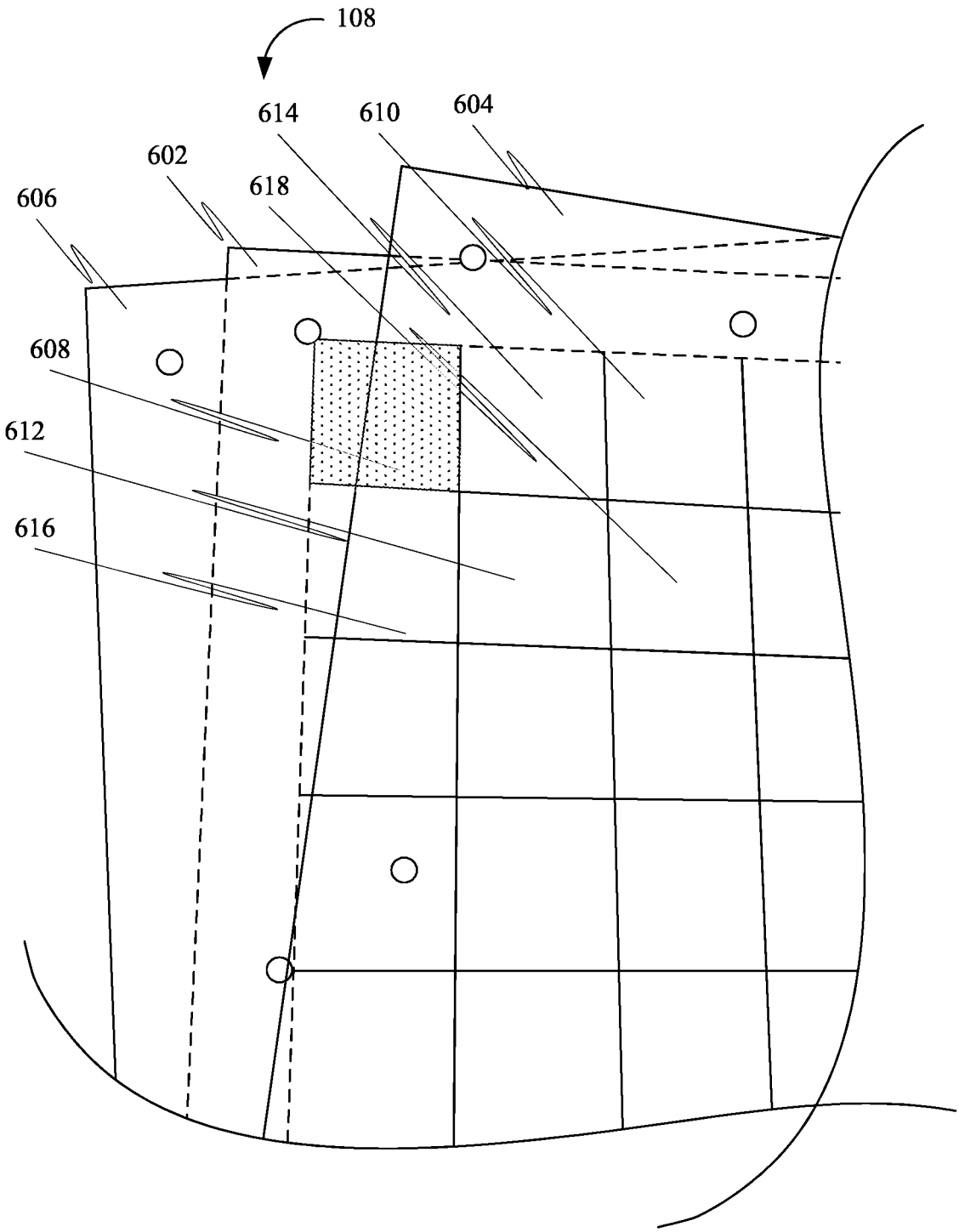
FIG. 6 is a disassembled view of the game board of the game apparatus, in accordance with some embodiments.

Further, in some embodiments, the game board 108 may include the top game board surface 114 and the bottom game board surface 202. Further, the game board 108 facilitates the gameplay on the at least one of the top game board surface 114 and the bottom game board surface 202 based on the elevating and the rotating. Further, in an embodiment, the game board 108 may include a template panel 602 (as shown in FIG. 6), two cover panels 604-606 (as shown in FIG. 6), and a plurality of first tiles (not shown). Further, the template panel 602 may include a plurality of slots 608-612 (as shown in FIG. 6) forming a plurality of second tiles 614-618 (as shown in FIG. 6) adjacent to the plurality of slots 608-612 on the template panel 602. Further, the plurality of first tiles may be disposed in the plurality of slots 608-612. Further, a first cover panel of the two cover panels 604-606 may be attached on a first side of the template panel 602 and a second cover panel of the two cover panels 604-606 may be attached on a second side of the template panel 602 for securing the plurality of first tiles in the plurality of slots 608-612 forming the top game board surface 114 on the first side and the bottom game board surface 202 on the second side. Further, the plurality of first tiles and the plurality of second tiles 614-618 may be arranged in an 8×8 grid forming a checkered board with 64 squares. Further, the plurality of first tiles and the plurality of second tiles 614-618 forms the plurality of game board surface portions 502-506.

Figure 8:
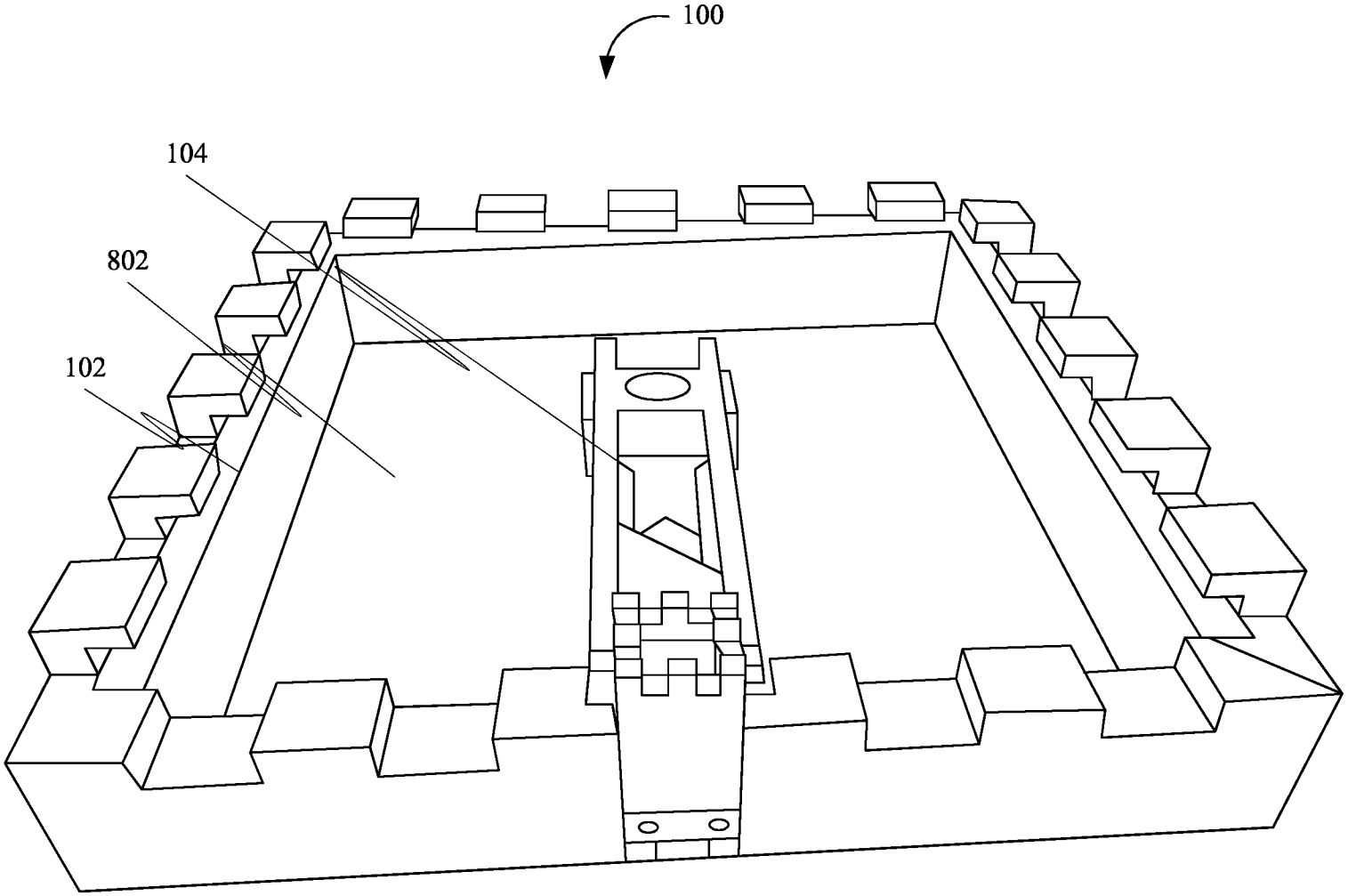
FIG. 8 is a top perspective view of the game apparatus without the game board, in accordance with some embodiments.

Further, in some embodiments, the game board 108 may include the top game board surface 114 and the bottom game board surface 202. Further, the game board 108 facilitates the gameplay on the at least one of the top game board surface 114 and the bottom game board surface 202 based on the elevating and the rotating. Further, in an embodiment, the top game board surface 114 of the game board 108 may be visually accessible to at least one user and the bottom game board surface 202 of the game board 108 may be not visually accessible to the at least one user in a first board position of the plurality of first board positions from at least one user viewing position of the at least one user. In further embodiments, at least one reflective panel 802, as shown in FIG. 8, may be disposed parallel to the base member 102. Further, the at least one reflective panel 802 may include at least one mirror. Further, the at least one reflective panel 802 may be configured for providing a visual access of the bottom game board surface 202 to the at least one user in the first board position from the at least one user viewing position. Further, the top game board surface 114 and the bottom game board surface 202 are simultaneously visually accessible to the at least one user based on the providing. Further, the at least one user may be at least one player.

Further, in some embodiments, the at least one support member 104-106 may be configured for receiving at least one external action on at least one support member 104-106 portion of the at least one support member 104-106. Further, the at least one external action may include a push action, a pull action, a screwing action, etc. Further, the extending of the at least one support member 104-106 may be based on the receiving of the at least one external action.

Further, in some embodiments, the game board 108 may be configured for receiving at least one first external action on at least one game board portion of the game board 108. Further, the at least one first external action may include a push action, a pull action, a screwing action, etc. Further, the rotating of the game board 108 may be based on the receiving of the at least one first external action.

Further, in some embodiments, the at least one support member 104-106 may be movably coupled with the base member 102 using at least one moving mechanism. Further, the at least one support member 104-106 may be configured for moving between a plurality of support member positions in relation to the base member 102. Further, the extending of the at least one support member 104-106 may be based on the moving.

Figure 10:
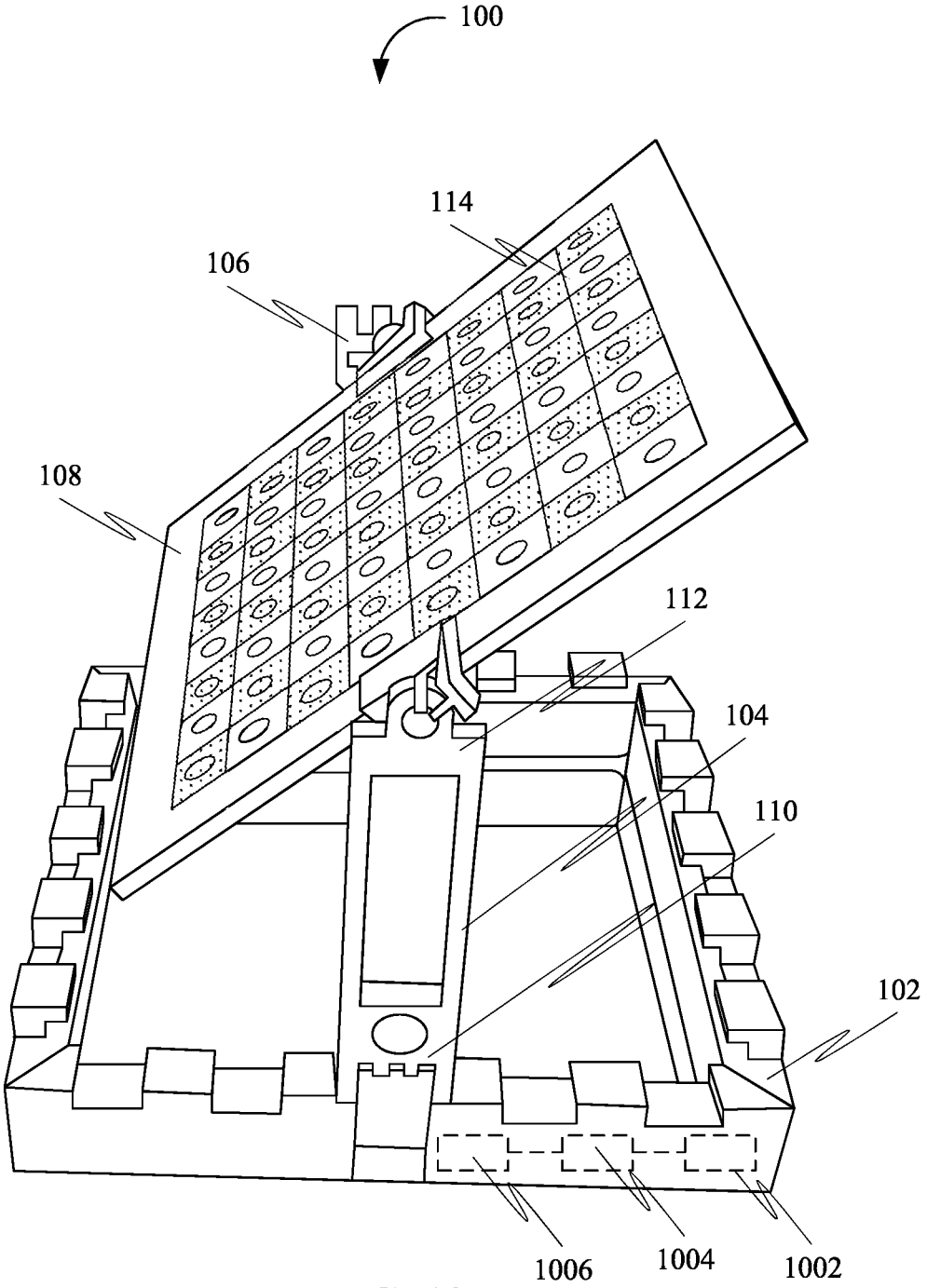
FIG. 10 is a top side perspective view of the game apparatus for facilitating the gameplay, in accordance with some embodiments.

In further embodiments, the game apparatus 100 may include at least one input device 1002 (as shown in FIG. 10), a processing device 1004 (as shown in FIG. 10), and at least one actuator 1006 (as shown in FIG. 10). Further, the at least one input device 1002 may be configured for receiving at least one input action on at least one device portion of the at least one input device 1002. Further, the at least one input device 1002 comprises a button. Further, the at least one input action may include a pushing action on the at least one device portion of the button. Further, the at least one input device 1002 may be configured for generating at least one input data based on the receiving of the at least one input action. Further, the processing device 1004 may be communicatively coupled with the at least one input device 1002. Further, the processing device 1004 may be configured for analyzing the at least one input data. Further, the processing device 1004 may be configured for generating a command based on the analyzing. Further, the at least one actuator 1006 may be operationally coupled with the at least one support member 104-106. Further, the at least one actuator 1006 may be communicatively coupled with the processing device 1004. Further, the at least one actuator 1006 may be electrically powered. Further, the at least one actuator 1006 may be configured for extending the at least one support member 104-106 to the plurality of positions based on the command. Further, the at least one actuator 1006 may include a servo motor, a hydraulic lift, etc.

Further, in an embodiment, a communication device may be communicatively coupled with the processing device 1004. Further, the communication device may be configured for receiving the at least one input data from at least one user device. Further, the at least one user device may be associated with the at least one user. Further, the at least one user device may include a computing device such as, but not limited to, a smartphone, a tablet, a smartwatch, a desktop, a laptop, and so on.

Further, in some embodiments, the game board 108 may include the top game board surface 114 and the bottom game board surface 202. Further, the game board 108 facilitates the gameplay on the at least one of the top game board surface 114 and the bottom game board surface 202 based on the elevating and the rotating. Further, the plurality of game pieces 402-412 may be configured to be positioned on the plurality of game board surface portions 502-506 of the at least one of the top game board surface 114 and the bottom game board surface 202 for facilitating the gameplay. In further embodiments, the game apparatus 100 may include a plurality of sensors 1102, a plurality of light emitting devices (not shown), and a processing device 1104. Further, the plurality of sensors 1102 may be disposed on the game board 108. Further, a sensor of the plurality of sensors 1102 may be configured for generating sensor data based on a presence of a game piece of the plurality of game pieces 402-412 on a game board surface portion of the plurality of game board surface portions 502-506. Further, the plurality of light emitting devices may be comprised in the plurality game board surface portions 502-506. Further, the plurality of light emitting devices may be electrically powered. Further, the plurality of light emitting devices may include a LED (light emitting diode) bulb, an incandescent lamp, a fluorescent lamp, etc. Further, the processing device 1104 may be communicatively coupled with the plurality of sensors 1102 and the plurality of light emitting devices.

Further, the processing device 1104 may be configured for analyzing the sensor data. Further, the processing device 1104 may be configured for identifying a light emitting device of the plurality of light emitting devices associated with the game board surface portion based on the analyzing. Further, the processing device 1104 may be configured for generating a first command based on the identifying. Further, the light emitting device may be configured for emitting light based on the first command.

Further, in an embodiment, the processing device 1104 may be configured for determining at least one movement made by the game piece on the plurality of game board surface portions 502-506. Further, the processing device 1104 may be configured for generating game data based on the determining of the at least one movement of the game piece. Further, a communication communicatively coupled with the processing device 1104. Further, the communication device may be configured for transmitting the game data to the at least one user device.

Further, in an embodiment, the plurality of game pieces 402-412 may include a plurality of first light emitting devices. Further, the plurality of first light emitting devices may be electrically powered. Further, the plurality of first light emitting devices may include a LED (light emitting diode) bulb, an incandescent lamp, a fluorescent lamp, etc. Further, the plurality of sensors 1102 may be configured for generating a plurality of first sensor data based on a plurality of relative presences of the plurality of game pieces 402-412 on the plurality of game board surface portions 502-506. Further, the processing device 1104 may be communicatively coupled with the plurality of first light emitting devices. Further, the processing device 1104 may be configured for analyzing the plurality of first sensor data. Further, the processing device 1104 may be identifying at least one first light emitting device comprised in at least one game piece of the plurality of game pieces 402-412. Further, the processing device 1104 may be generating a second command based on the identifying of the at least one first light emitting device. Further, the at least one first light emitting device may be configured for emitting light based on the second command.

FIG. 2 is a bottom side perspective view of the game apparatus 100 for facilitating the gameplay, in accordance with some embodiments.

Figure 3:
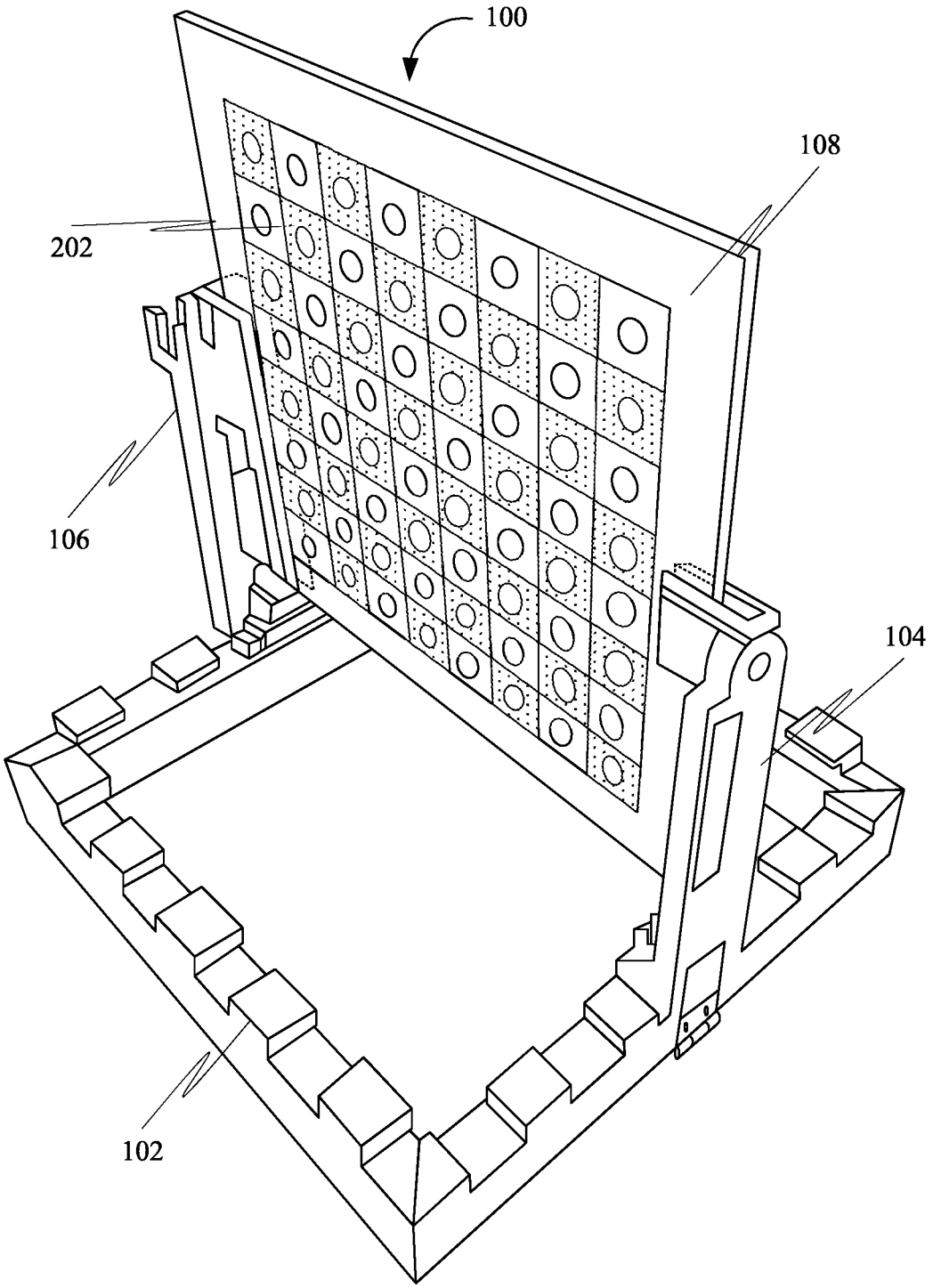
FIG. 3 is a top side perspective view of the game apparatus for facilitating the gameplay, in accordance with some embodiments.

FIG. 3 is a top side perspective view of the game apparatus 100 for facilitating the gameplay, in accordance with some embodiments.

FIG. 4 is a side perspective view of the game apparatus 100 with the plurality of game pieces 402-412, in accordance with some embodiments.

FIG. 5 is a top view of the game board 108 of the game apparatus 100, in accordance with some embodiments.

FIG. 6 is a disassembled view of the game board 108 of the game apparatus 100, in accordance with some embodiments.

Figure 7:
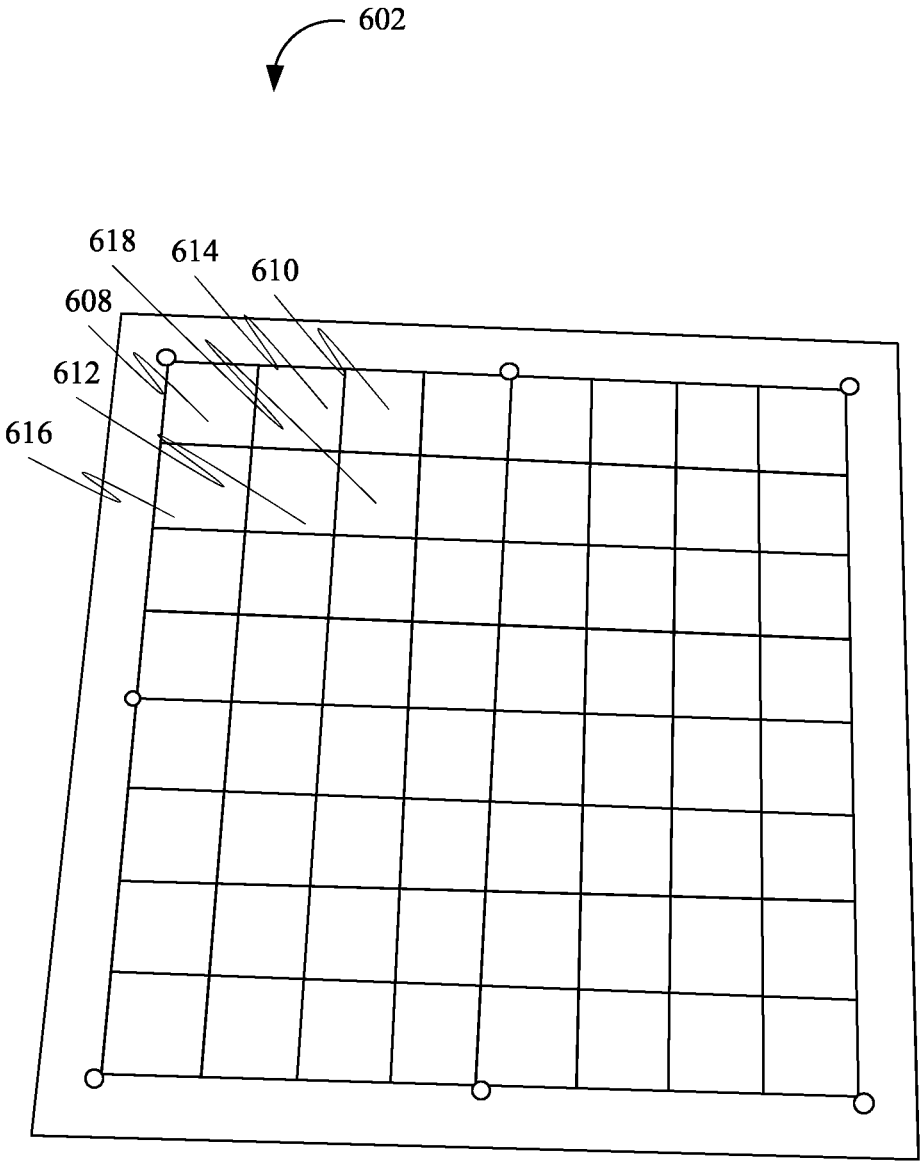
FIG. 7 is a top view of the template panel of the game board, in accordance with some embodiments.

FIG. 7 is a top view of the template panel 602 of the game board 108, in accordance with some embodiments.

FIG. 8 is a top perspective view of the game apparatus 100 without the game board 108, in accordance with some embodiments.

Figure 9:
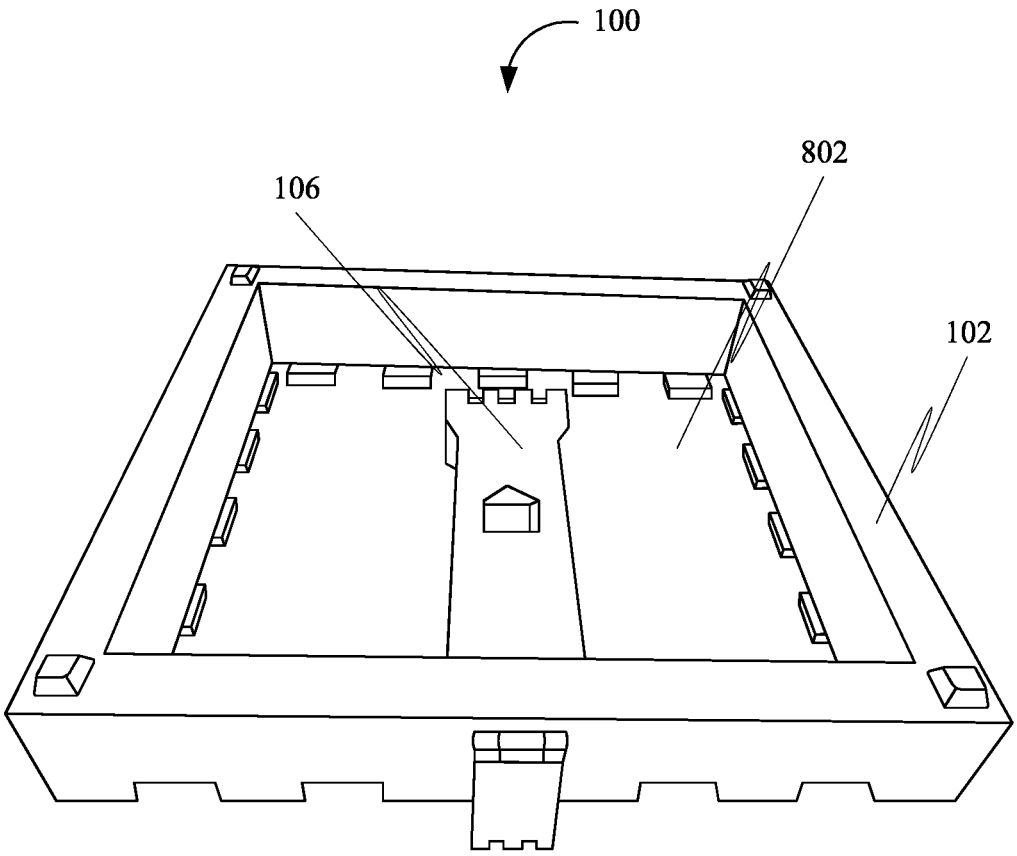
FIG. 9 is a bottom perspective view of the game apparatus without the game board, in accordance with some embodiments.

FIG. 9 is a bottom perspective view of the game apparatus 100 without the game board 108, in accordance with some embodiments.

FIG. 10 is a top side perspective view of the game apparatus 100 for facilitating the gameplay, in accordance with some embodiments.

Figure 11:
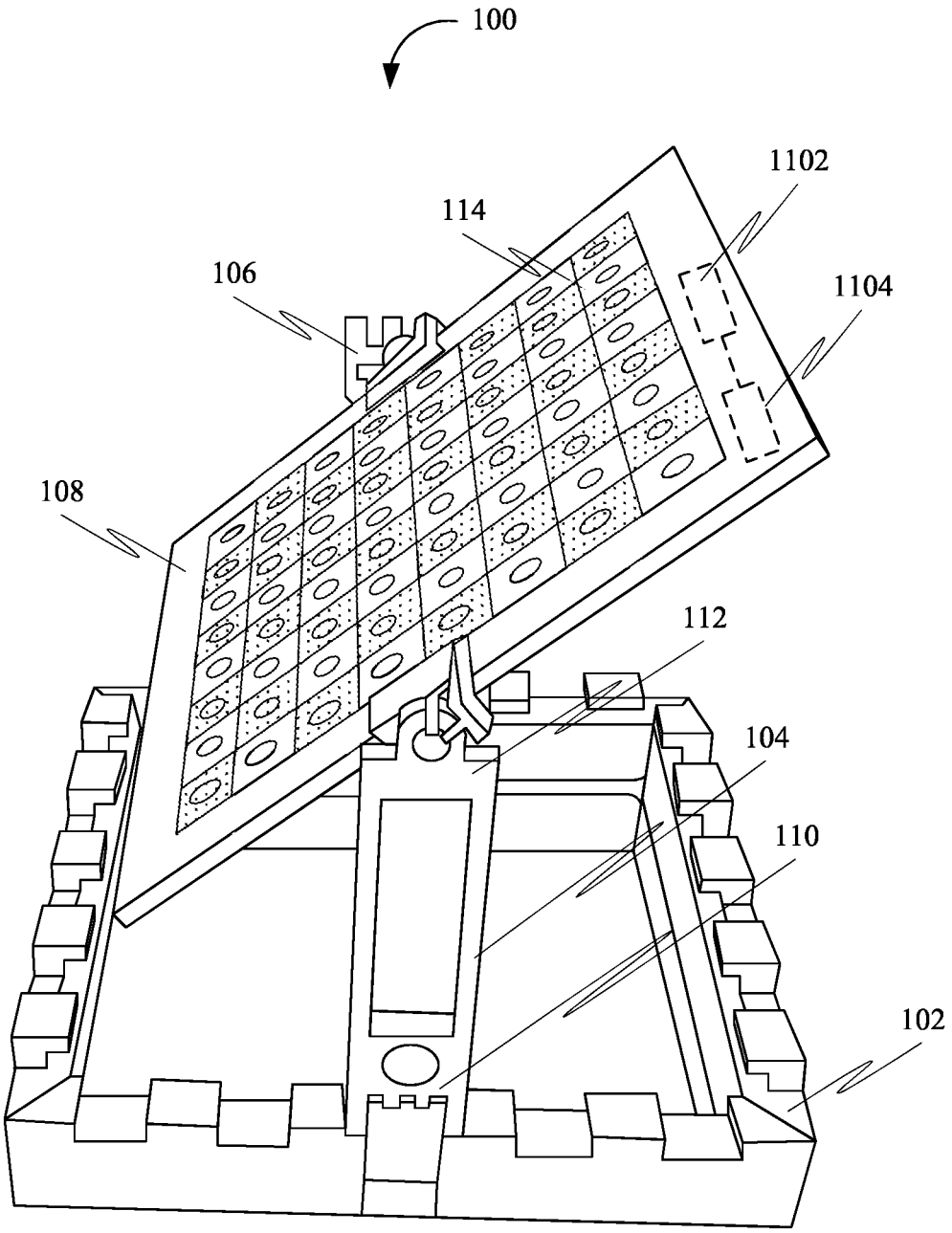
FIG. 11 is a top side perspective view of the game apparatus for facilitating the gameplay, in accordance with some embodiments.

FIG. 11 is a top side perspective view of the game apparatus 100 for facilitating the gameplay, in accordance with some embodiments.

Figure 12:
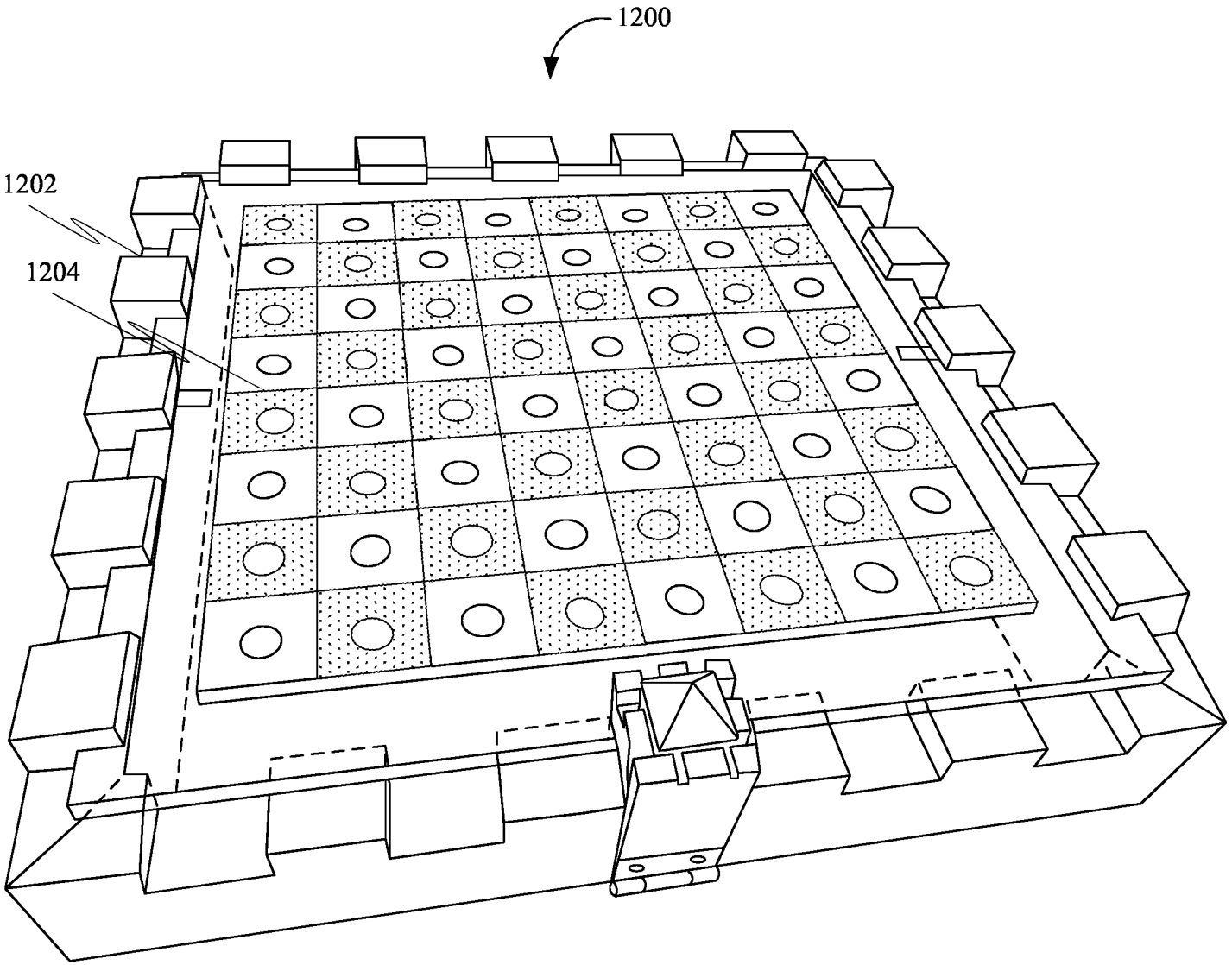
FIG. 12 is a top perspective view of a Hitened Chess apparatus for facilitating a gameplay, in accordance with some embodiments.
Figure 13:
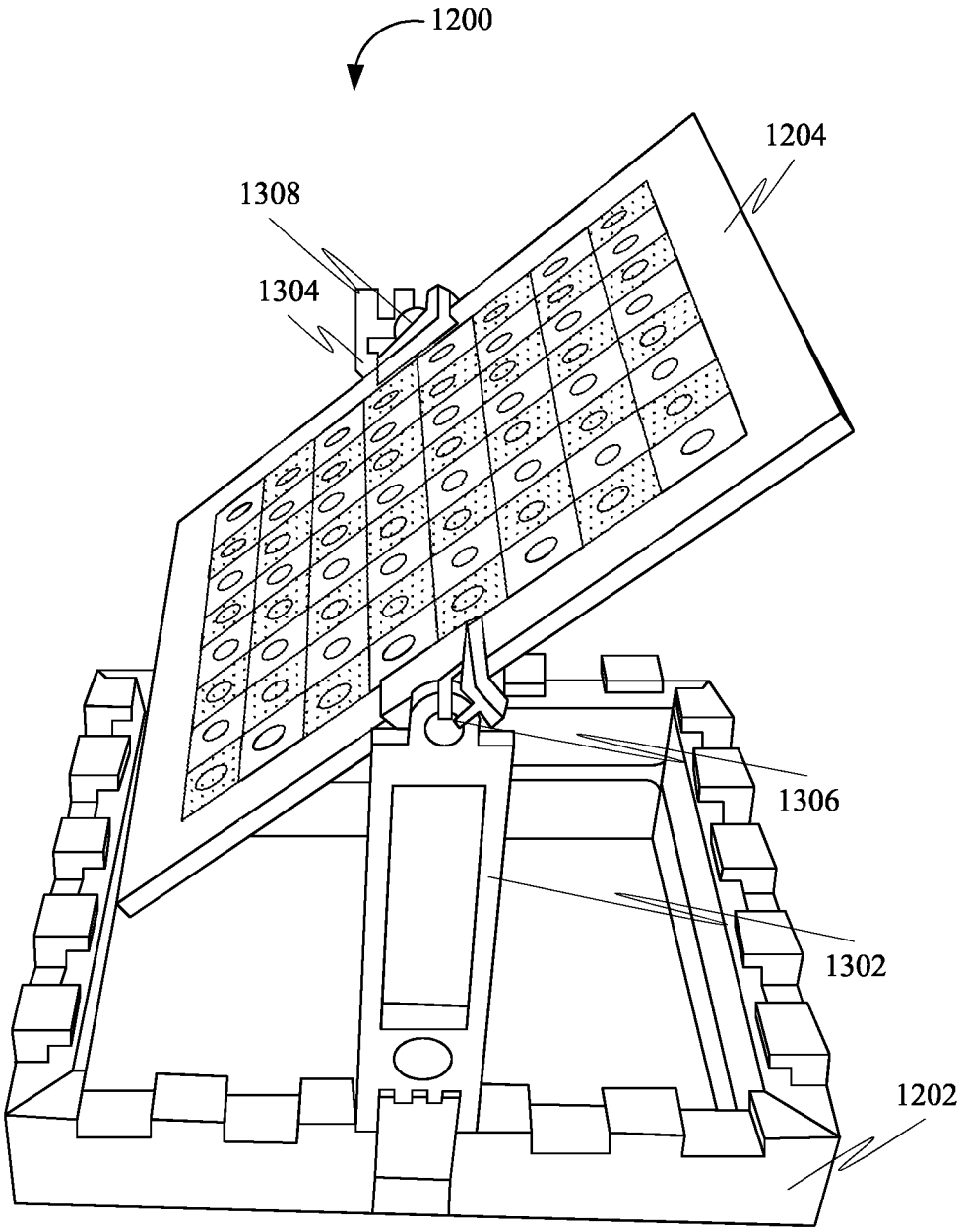
FIG. 13 is a top side perspective view of the Hitened Chess apparatus with the Sticky Board elevated to a height, in accordance with some embodiments.
Figure 16:
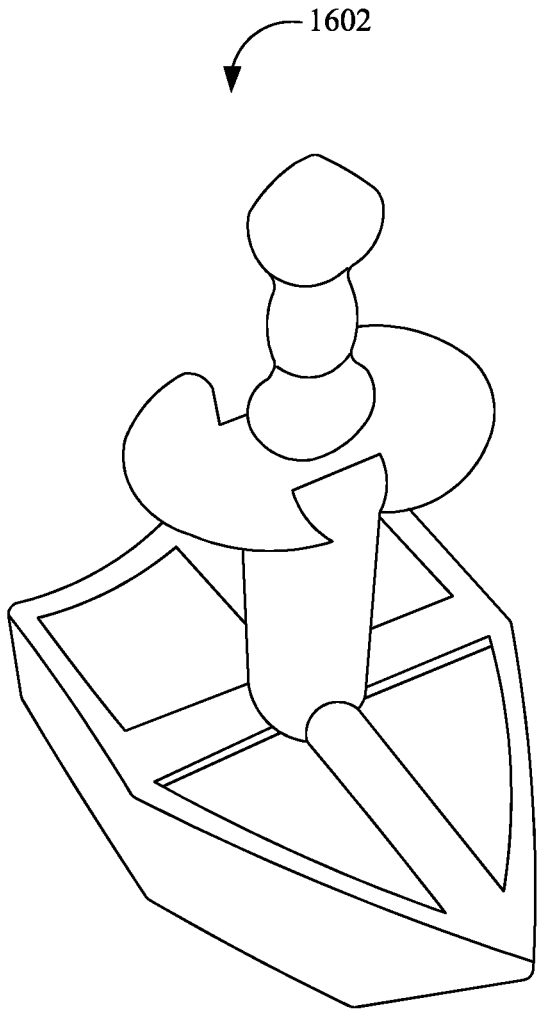
FIG. 16 is a perspective view of the Shield Lock of the Tower Support, in accordance with some embodiments.
Figure 19:
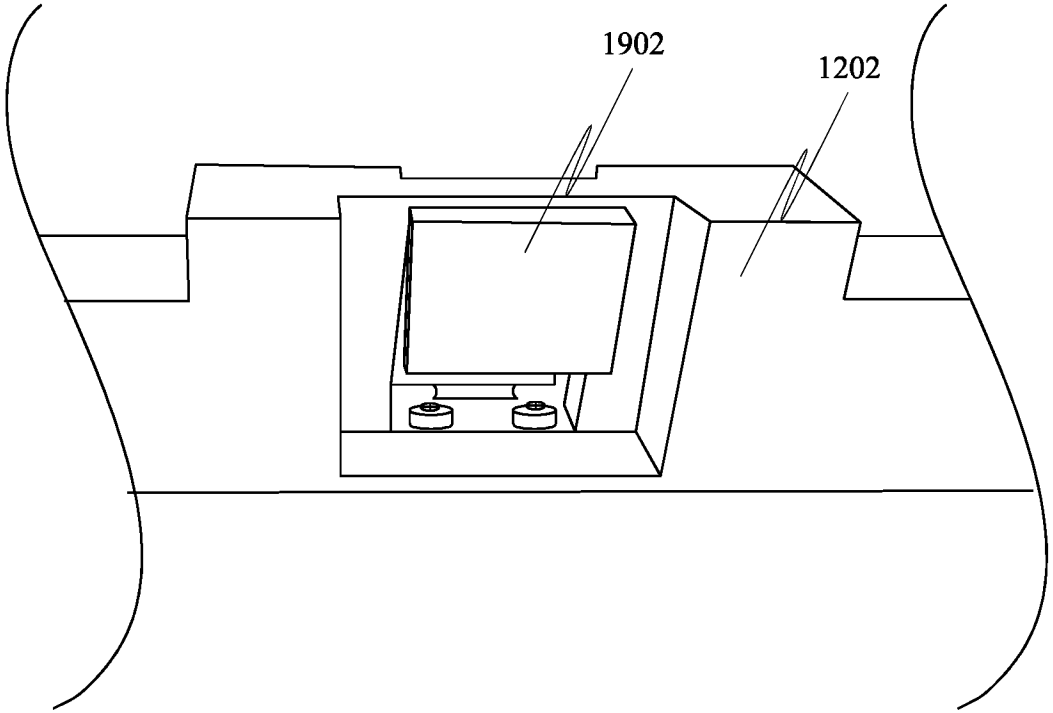
FIG. 19 is a front view of the Drawbridge Turret of the Hitened Chess apparatus, in accordance with some embodiments.

FIG. 12 is a top perspective view of a Hitened Chess apparatus 1200 for facilitating a gameplay, in accordance with some embodiments. Further, the Hitened Chess apparatus 1200 may be the game apparatus 100. Further, the Hitened Chess apparatus 1200 may include a Castle Box 1202. Further, the Castle Box (CB) 1202 may be a chess board base/storage box designed to look like a castle with notched crenellations (battlements of a castle) atop. Further, the Castle Box (CB) 1202 may be the base member 102. Further, three of the walls that serve as horizontal rails for a Sticky Board (SB) 1204 to slide in and out of; also functioning as the foothold connection for a Tower Support (TS) 1304, as shown in FIG. 13. Further, the Sticky Board (SB) 1204 may be the game board 108. Further, the Tower Support (TS) 1304 may be a model sized castle tower with a specially designed head (eye) that may receive a Pivot Key 1308. Further, the Tower Support (TS) 1304 may be the at least one support member 104-106. Further, the Tower Support (TS) 1304 may have a specially designed footing that may slide into the base and can lock into place with a Shield Lock 1602, as shown in FIG. 16. Further, the Shield Lock 1602 may be free sliding in the Tower Support (TS) 1304 and detachable from the Tower Support (TS) 1304. Further, the Sticky Board (SB) 1204 may be a transparent 8×8 tile Black/Clear chessboard with neodymium magnets embedded and sealed within the center of each tile, allowing chess pieces to magnetize to both sides of the board regardless if right-side-up or inverted. Further, a front wall of the Castle Box (CB) 1202 may set slightly lower than the other three walls. Low enough for the Sticky Board (SB) 1204 to clear when horizontally inserted; seamlessly sliding into the sidewall crenellations to seal the top of the box closed. Further, the front wall may have a centered, magnetized, and hinged a Drawbridge Turret (DT) 1902 (as shown in FIG. 19) that functions as the locking mechanism to lock the Sticky Board (SB) 1204 in place when closed; it also serves as the foothold connection for a Guillotine Support (GS) 1302, as shown in FIG. 13. Further, the Guillotine Support (GS) 1302 may be the at least one support member 104-106. Further, the Guillotine Support (GS) 1302 may be a model sized guillotine with a specially designed top that may receive a Pivot Key 1306, as shown in FIG. 13. Further, the Guillotine Support (GS) 1302 may have specially designed footing that attaches to the base, locking it into place when the free sliding Blade Lock (BL) may be down. Further, enabling the Guillotine Support (GS) 1302 to swing open and closed, locking and releasing the Sticky Board (SB) 1204 in/from the heightened position.

FIG. 13 is a top side perspective view of the Hitened Chess apparatus 1200 with the Sticky Board 1204 elevated to a height, in accordance with some embodiments.

Figure 14:
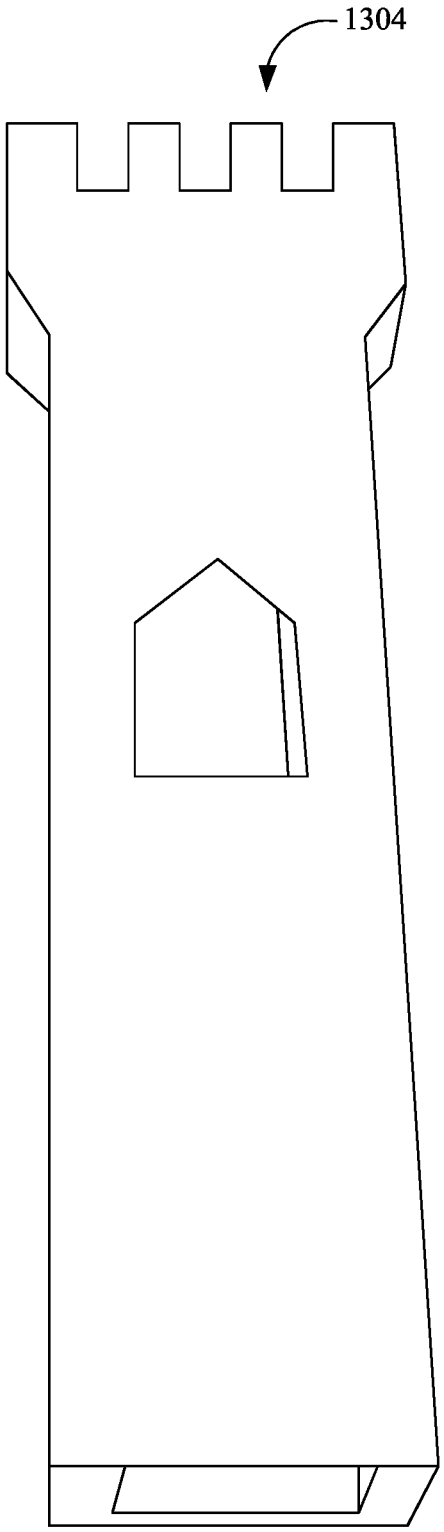
FIG. 14 is a front view of the Tower Support of the Hitened Chess apparatus, in accordance with some embodiments.

FIG. 14 is a front view of the Tower Support 1304 of the Hitened Chess apparatus 1200, in accordance with some embodiments.

Figure 15:
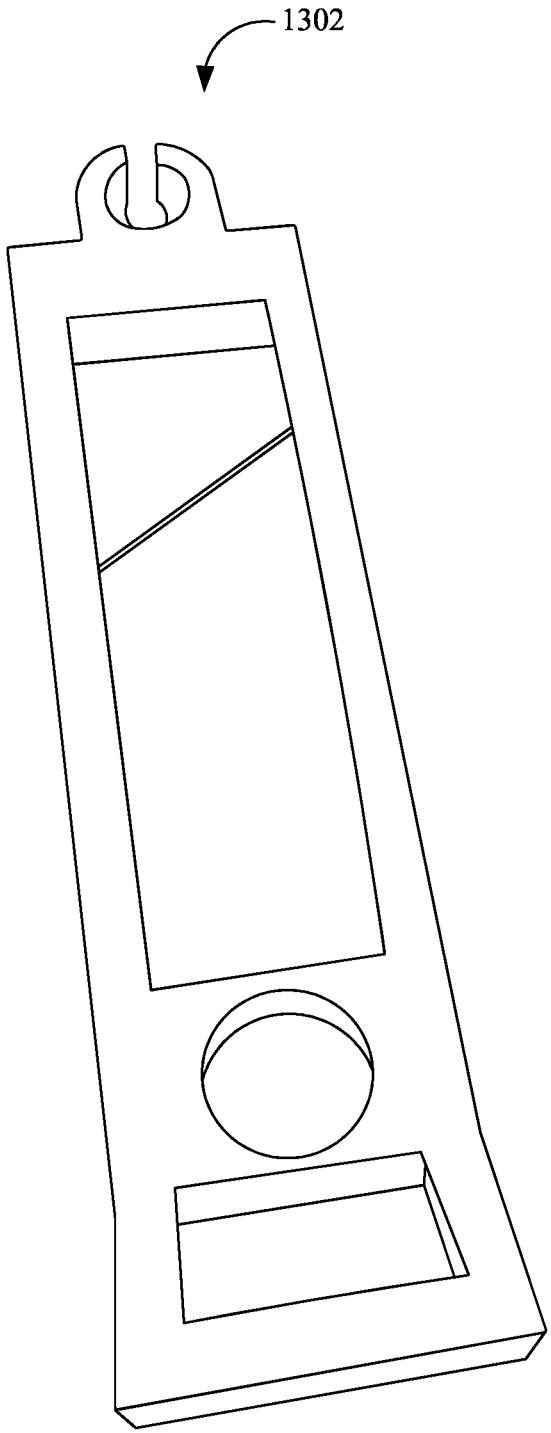
FIG. 15 is a front view of the Guillotine Support of the Hitened Chess apparatus, in accordance with some embodiments.

FIG. 15 is a front view of the Guillotine Support 1302 of the Hitened Chess apparatus 1200, in accordance with some embodiments.

FIG. 16 is a perspective view of the Shield Lock 1602 of the Tower Support 1304, in accordance with some embodiments.

Figure 17:
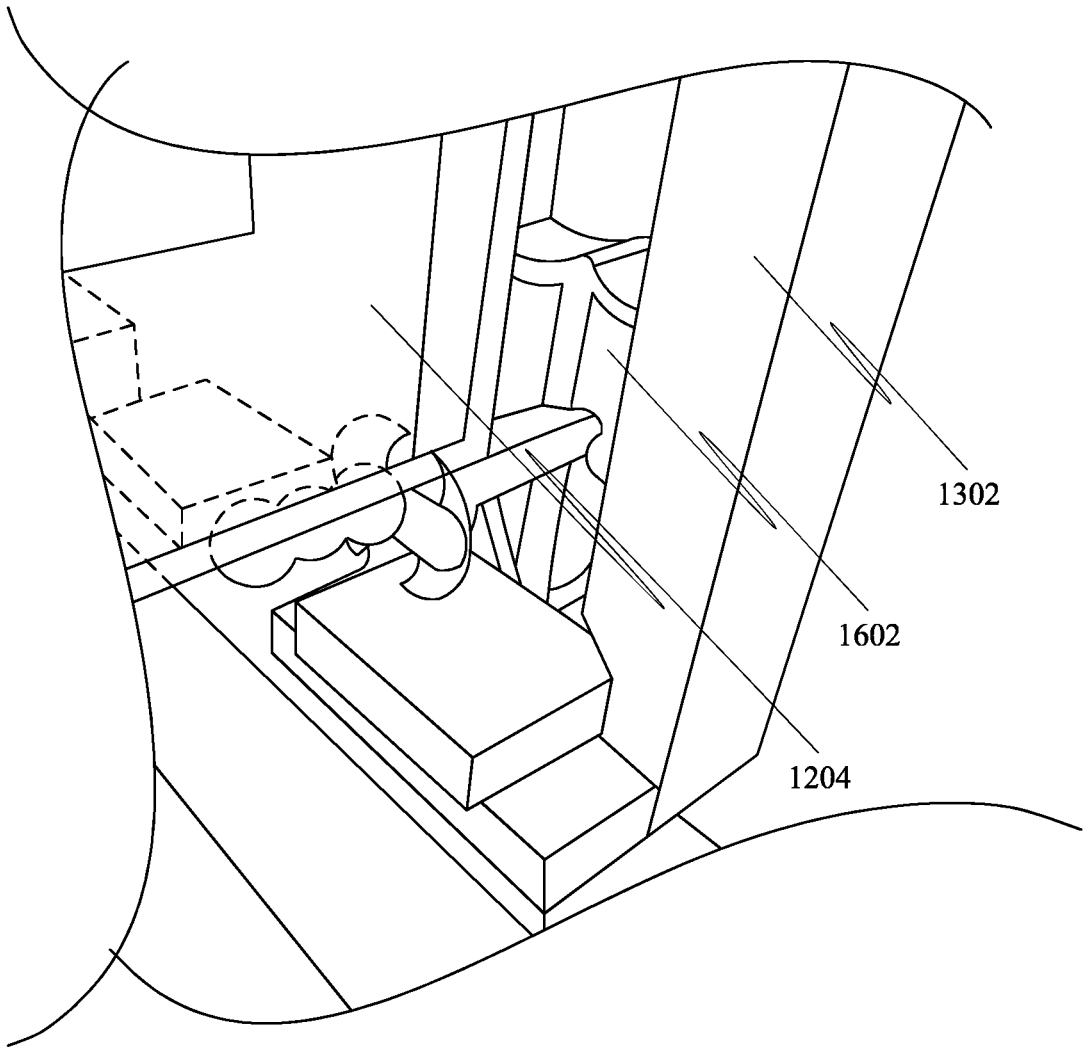
FIG. 17 is a partial view of the Tower Support with the Shield Lock, in accordance with some embodiments.

FIG. 17 is a partial view of the Tower Support 1304 with the Shield Lock 1602, in accordance with some embodiments.

Figure 18:
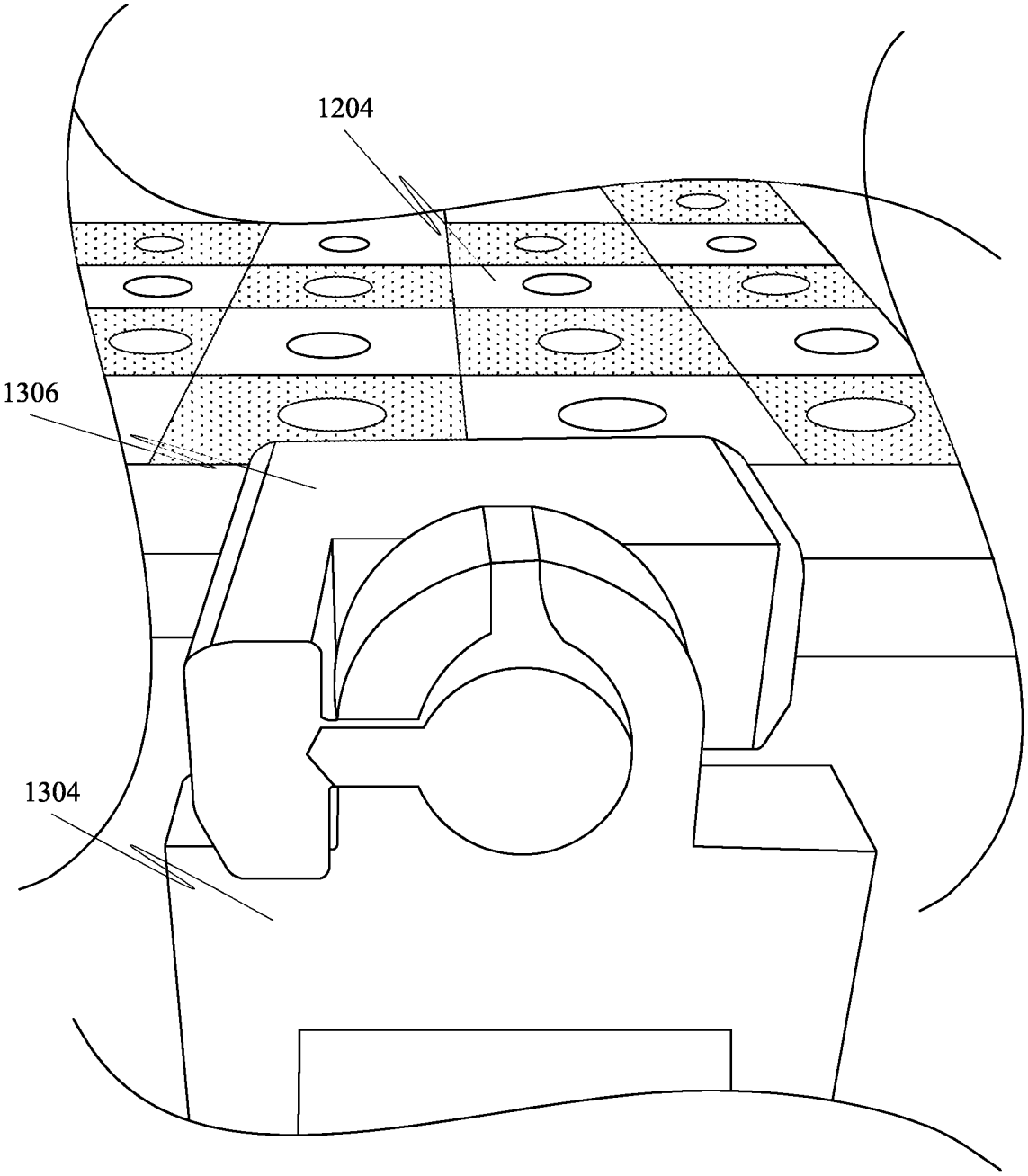
FIG. 18 is a front perspective view of the Pivot Key of the Hitened Chess apparatus, in accordance with some embodiments.

FIG. 18 is a front perspective view of the Pivot Key 1306 of the Hitened Chess apparatus 1200, in accordance with some embodiments.

FIG. 19 is a back view of the Drawbridge Turret 1902 of the Hitened Chess apparatus 1200, in accordance with some embodiments.

Figure 20:
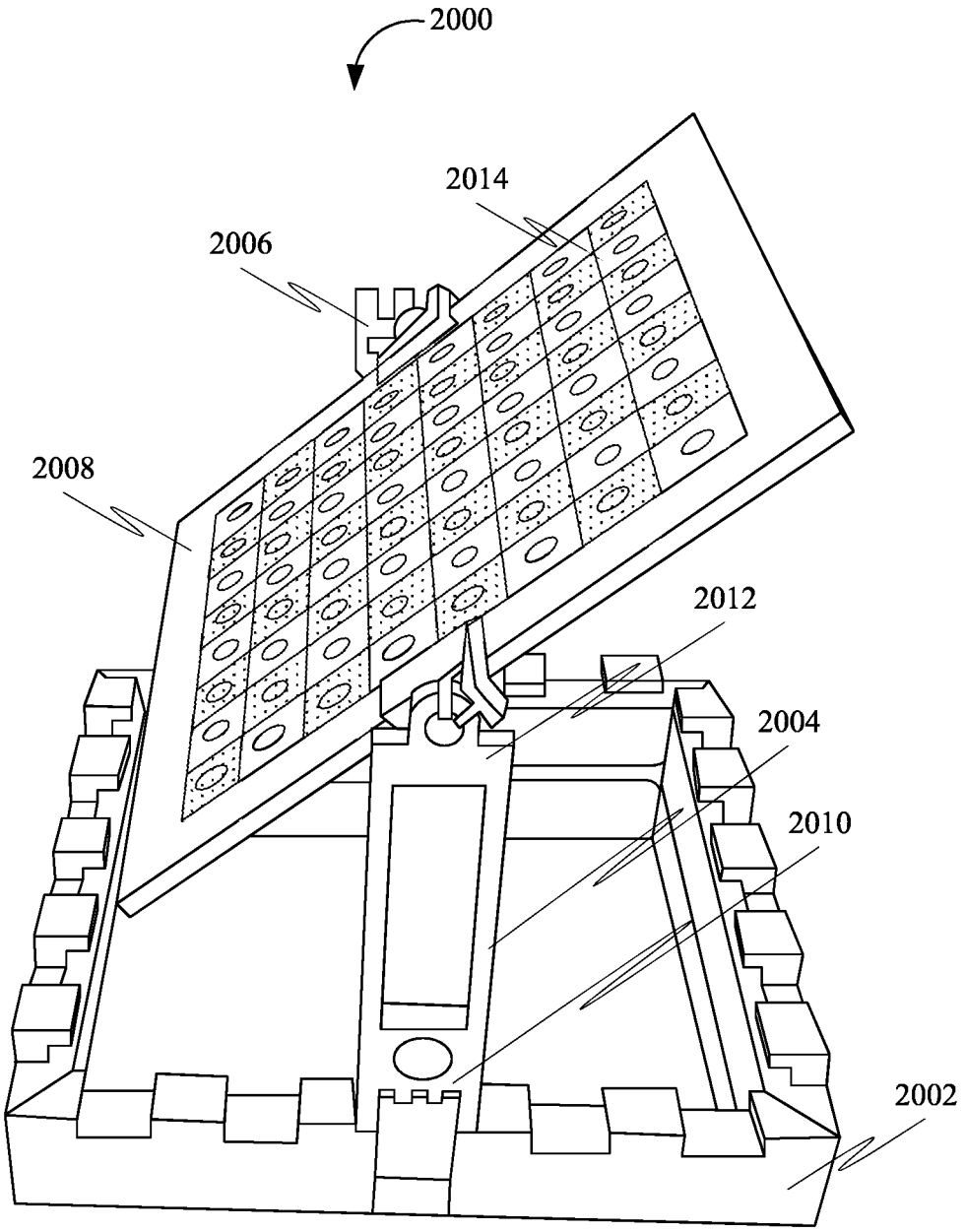
FIG. 20 is a top side perspective view of a game apparatus for facilitating a gameplay, in accordance with some embodiments.

FIG. 20 is a top side perspective view of a game apparatus 2000 for facilitating a gameplay, in accordance with some embodiments. Further, the game apparatus 2000 may include a base member 2002, at least one support member 2004-2006, and a game board 2008.

Further, the base member 2002 may be disposable on at least one surface.

Further, the at least one support member 2004-2006 may be coupled to the base member 2002. Further, a support member 2004 of the at least one support member 2004-2006 may include a first support member end 2010 and a second support member end 2012. Further, the first support member end 2010 may be attached to the base member 2002. Further, the at least one support member 2004-2006 may be configured for extending between a plurality of positions in relation to the base member 2002.

Figure 21:
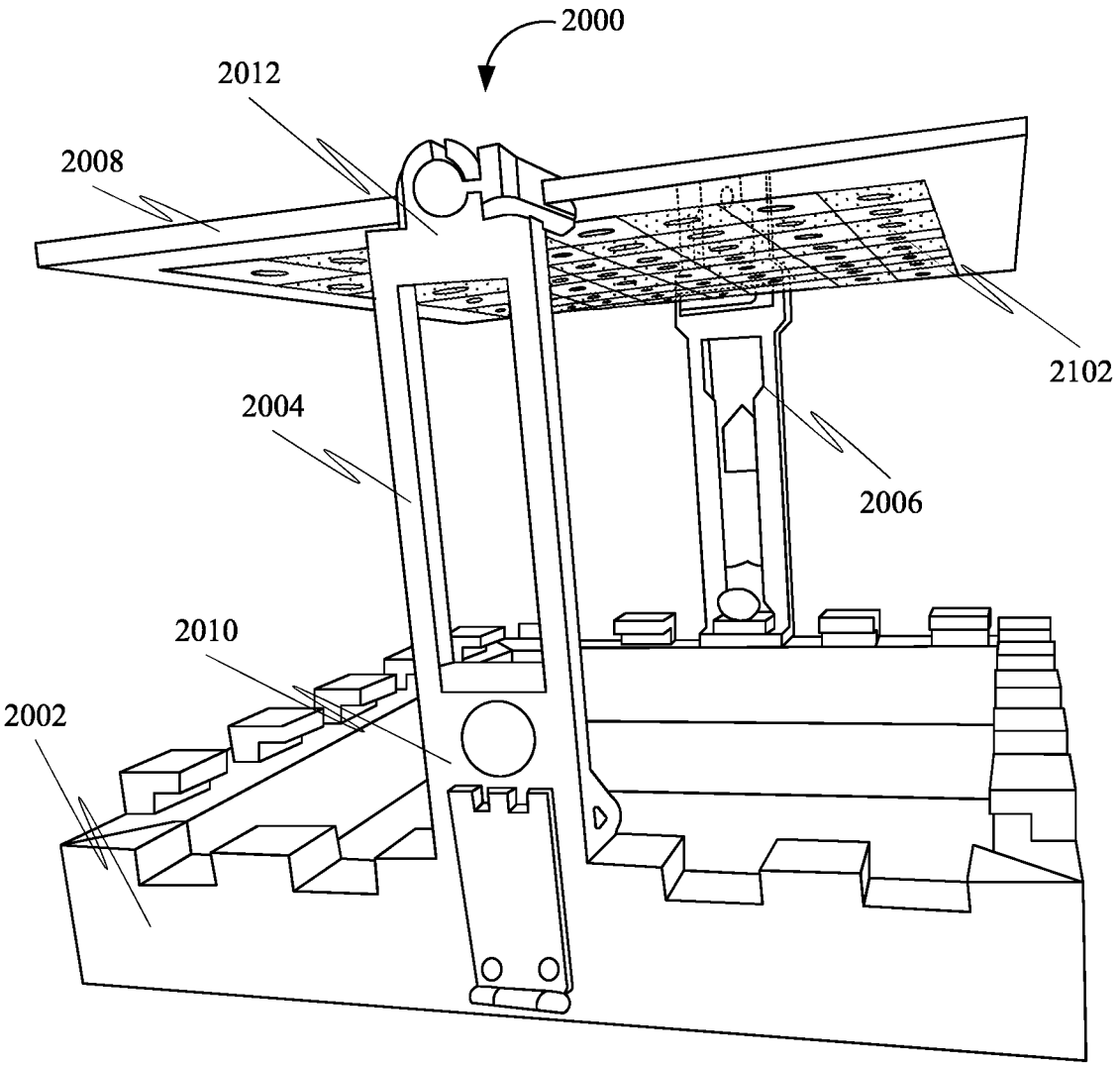
FIG. 21 is a bottom side perspective view of the game apparatus for facilitating the gameplay, in accordance with some embodiments.

Further, the game board 2008 may be rotatably coupled with the second support member end 2012. Further, the game board 2008 may be configured for rotating about a board axis between a plurality of first board positions. Further, the board axis may be parallel to the base member 2002. Further, the at least one support member 2004-2006 may be configured for elevating the game board 2008 to a plurality of board positions in relation to the at least one surface based on the extending of the at least one support member 2004-2006 between the plurality of positions. Further, the game board 2008 facilitates the gameplay based on the elevating and the rotating. Further, the game board 2008 may include a top game board surface 2014 and a bottom game board surface 2102, as shown in FIG. 21. Further, the game board 2008 facilitates the gameplay on at least one of the top game board surface 2014 and the bottom game board surface 2102 based on the elevating and the rotating.

In further embodiments, the game apparatus 2000 may include a plurality of game pieces. Further, the plurality of game pieces may be configured to be positioned on a plurality of game board surface portions of the at least one of the top game board surface 2014 and the bottom game board surface 2102 for facilitating the gameplay. Further, in an embodiment, the game board 2008 may include a plurality of adhering elements. Further, the plurality of adhering elements may be comprised in the plurality of game board surface portions. Further, the plurality of adhering elements may be configured for attaching the plurality of game pieces on the plurality of game board surface portions in at least one of the plurality of first board positions and the plurality of board positions. Further, in an embodiment, the plurality of game pieces may include a plurality of first adhering elements. Further, the plurality of first adhering elements may be configured for attaching the plurality of game pieces to the plurality of game board surface portions in at least one of the plurality of first board positions and the plurality of board positions.

FIG. 21 is a bottom side perspective view of the game apparatus 2000 for facilitating the gameplay, in accordance with some embodiments.

Figure 22:
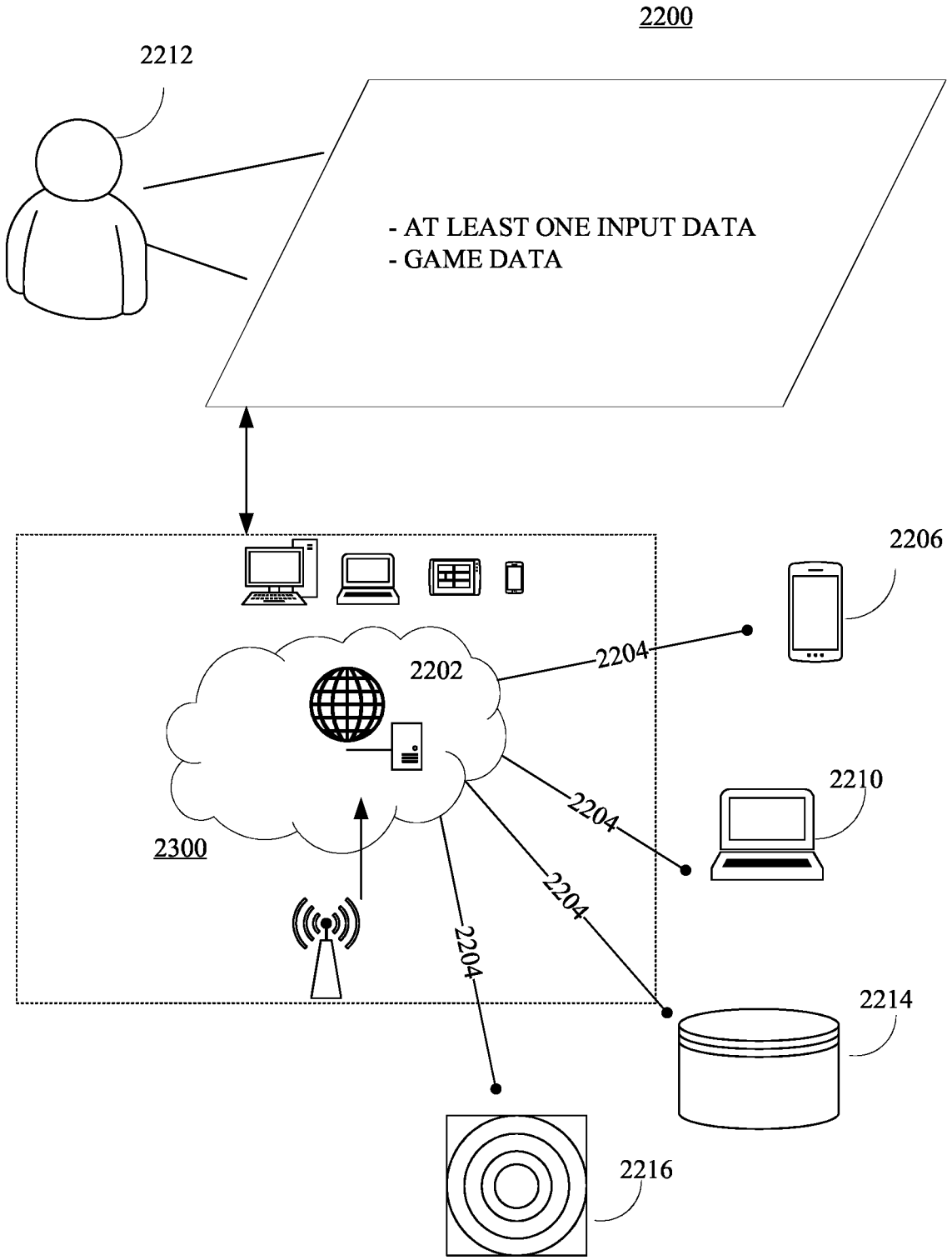
FIG. 22 is an illustration of an online platform consistent with various embodiments of the present disclosure.

FIG. 22 is an illustration of an online platform 2200 consistent with various embodiments of the present disclosure. By way of non-limiting example, the online platform 2200 to facilitate game apparatus for facilitating a gameplay may be hosted on a centralized server 2202, such as, for example, a cloud computing service. The centralized server 2202 may communicate with other network entities, such as, for example, a mobile device 2206 (such as a smartphone, a laptop, a tablet computer etc.), other electronic devices 2210 (such as desktop computers, server computers etc.), databases 2214, and sensors 2216 over a communication network 2204, such as, but not limited to, the Internet. Further, users of the online platform 2200 may include relevant parties such as, but not limited to, end-users, administrators, service providers, and service consumers and so on. Accordingly, in some instances, electronic devices operated by the one or more relevant parties may be in communication with the platform.

A user 2212, such as the one or more relevant parties, may access online platform 2200 through a web based software application or browser. The web based software application may be embodied as, for example, but not be limited to, a website, a web application, a desktop application, and a mobile application compatible with a computing device 2300.

Figure 23:
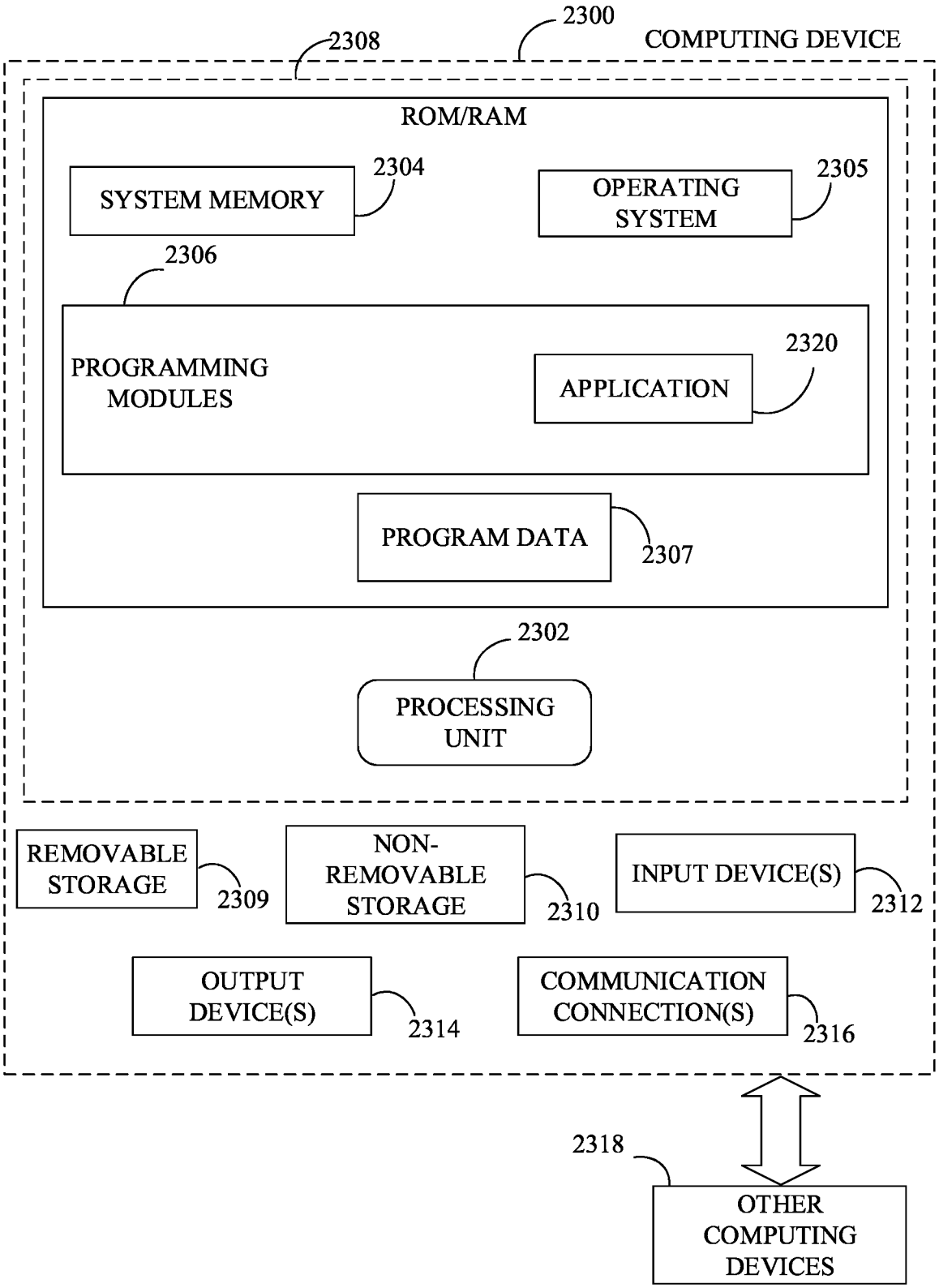
FIG. 23 is a block diagram of a computing device for implementing the methods disclosed herein, in accordance with some embodiments.

With reference to FIG. 23, a system consistent with an embodiment of the disclosure may include a computing device or cloud service, such as computing device 2300. In a basic configuration, computing device 2300 may include at least one processing unit 2302 and a system memory 2304. Depending on the configuration and type of computing device, system memory 2304 may comprise, but is not limited to, volatile (e.g. random-access memory (RAM)), non-volatile (e.g. read-only memory (ROM)), flash memory, or any combination. System memory 2304 may include operating system 2305, one or more programming modules 2306, and may include a program data 2307. Operating system 2305, for example, may be suitable for controlling computing device 2300's operation. Furthermore, embodiments of the disclosure may be practiced in conjunction with a graphics library, other operating systems, or any other application program and is not limited to any particular application or system. This basic configuration is illustrated in FIG. 23 by those components within a dashed line 2308.

Computing device 2300 may have additional features or functionality. For example, computing device 2300 may also include additional data storage devices (removable and/or non-removable) such as, for example, magnetic disks, optical disks, or tape. Such additional storage is illustrated in FIG. 23 by a removable storage 2309 and a non-removable storage 2310. Computer storage media may include volatile and non-volatile, removable and non-removable media implemented in any method or technology for storage of information, such as computer-readable instructions, data structures, program modules, or other data. System memory 2304, removable storage 2309, and non-removable storage 2310 are all computer storage media examples (i.e., memory storage.) Computer storage media may include, but is not limited to, RAM, ROM, electrically erasable read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store information and which can be accessed by computing device 2300. Any such computer storage media may be part of device 2300. Computing device 2300 may also have input device(s) 2312 such as a keyboard, a mouse, a pen, a sound input device, a touch input device, a location sensor, a camera, a biometric sensor, etc. Output device(s) 2314 such as a display, speakers, a printer, etc. may also be included. The aforementioned devices are examples and others may be used.

Computing device 2300 may also contain a communication connection 2316 that may allow device 2300 to communicate with other computing devices 2318, such as over a network in a distributed computing environment, for example, an intranet or the Internet. Communication connection 2316 is one example of communication media. Communication media may typically be embodied by computer readable instructions, data structures, program modules, or other data in a modulated data signal, such as a carrier wave or other transport mechanism, and includes any information delivery media. The term "modulated data signal" may describe a signal that has one or more characteristics set or changed in such a manner as to encode information in the signal. By way of example, and not limitation, communication media may include wired media such as a wired network or direct-wired connection, and wireless media such as acoustic, radio frequency (RF), infrared, and other wireless media. The term computer readable media as used herein may include both storage media and communication media.

As stated above, a number of program modules and data files may be stored in system memory 2304, including operating system 2305. While executing on processing unit 2302, programming modules 2306 may perform processes including, for example, one or more stages of methods, algorithms, systems, applications, servers, databases as described above. The aforementioned process is an example, and processing unit 2302 may perform other processes. Other programming modules that may be used in accordance with embodiments of the present disclosure may include machine learning applications.

Generally, consistent with embodiments of the disclosure, program modules may include routines, programs, components, data structures, and other types of structures that may perform particular tasks or that may implement particular abstract data types. Moreover, embodiments of the disclosure may be practiced with other computer system configurations, including hand-held devices, general purpose graphics processor-based systems, multiprocessor systems, microprocessor-based or programmable consumer electronics, application specific integrated circuit-based electronics, minicomputers, mainframe computers, and the like. Embodiments of the disclosure may also be practiced in distributed computing environments where tasks are performed by remote processing devices that are linked through a communications network. In a distributed computing environment, program modules may be located in both local and remote memory storage devices.

Furthermore, embodiments of the disclosure may be practiced in an electrical circuit comprising discrete electronic elements, packaged or integrated electronic chips containing logic gates, a circuit utilizing a microprocessor, or on a single chip containing electronic elements or microprocessors. Embodiments of the disclosure may also be practiced using other technologies capable of performing logical operations such as, for example, AND, OR, and NOT, including but not limited to mechanical, optical, fluidic, and quantum technologies. In addition, embodiments of the disclosure may be practiced within a general-purpose computer or in any other circuits or systems.

Embodiments of the disclosure, for example, may be implemented as a computer process (method), a computing system, or as an article of manufacture, such as a computer program product or computer readable media. The computer program product may be a computer storage media readable by a computer system and encoding a computer program of instructions for executing a computer process. The computer program product may also be a propagated signal on a carrier readable by a computing system and encoding a computer program of instructions for executing a computer process. Accordingly, the present disclosure may be embodied in hardware and/or in software (including firmware, resident software, micro-code, etc.). In other words, embodiments of the present disclosure may take the form of a computer program product on a computer-usable or computer-readable storage medium having computer-usable or computer-readable program code embodied in the medium for use by or in connection with an instruction execution system. A computer-usable or computer-readable medium may be any medium that can contain, store, communicate, propagate, or transport the program for use by or in connection with the instruction execution system, apparatus, or device.

The computer-usable or computer-readable medium may be, for example but not limited to, an electronic, magnetic, optical, electromagnetic, infrared, or semiconductor system, apparatus, device, or propagation medium. More specific computer-readable medium examples (a non-exhaustive list), the computer-readable medium may include the following: an electrical connection having one or more wires, a portable computer diskette, a random-access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

Embodiments of the present disclosure, for example, are described above with reference to block diagrams and/or operational illustrations of methods, systems, and computer program products according to embodiments of the disclosure. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments of the disclosure have been described, other embodiments may exist. Furthermore, although embodiments of the present disclosure have been described as being associated with data stored in memory and other storage mediums, data can also be stored on or read from other types of computer-readable media, such as secondary storage devices, like hard disks, solid state storage (e.g., USB drive), or a CD-ROM, a carrier wave from the Internet, or other forms of RAM or ROM. Further, the disclosed methods' stages may be modified in any manner, including by reordering stages and/or inserting or deleting stages, without departing from the disclosure.

Although the present disclosure has been explained in relation to its preferred embodiment, it is to be understood that many other possible modifications and variations can be made without departing from the spirit and scope of the disclosure.

What is claimed is:

1. A game apparatus for facilitating a gameplay, the game apparatus comprising:

a base member disposable on at least one surface;

at least one support member coupled to the base member, wherein a support member of the at least one support member comprises a first support member end and a second support member end, wherein the first support member end is attached to the base member, wherein the at least one support member is configured for extending between a plurality of positions in relation to the base member;

a game board rotatably coupled with the second support member end, wherein the game board is configured for rotating about a board axis between a plurality of first board positions, wherein the board axis is parallel to the base member, wherein the at least one support member is configured for elevating the game board to a plurality of board positions in relation to the at least one surface based on the extending of the at least one support member between the plurality of positions, wherein the game board facilitates the gameplay based on the elevating and the rotating;

the game board comprises a top game board surface and a bottom game board surface, wherein the game board facilitates the gameplay on at least one of the top game board surface and the bottom game board surface based on the elevating and the rotating;

the game board comprises a template panel, two cover panels, and a plurality of first tiles, wherein the template panel comprises a plurality of slots forming a plurality of second tiles adjacent to the plurality of slots on the template panel, wherein the plurality of first tiles is disposed in the plurality of slots, wherein a first cover panel of the two cover panels is attached on a first side of the template panel and a second cover panel of the two cover panels is attached on a second side of the template panel for securing the plurality of first tiles in the plurality of slots forming the top game board surface on the first side and the bottom game board surface on the second side.

2. The game apparatus of claim 1 further comprising a plurality of game pieces, wherein the plurality of game pieces is configured to be positioned on a plurality of game board surface portions of the at least one of the top game board surface and the bottom game board surface for facilitating the gameplay.

3. The game apparatus of claim 2, wherein the game board comprises a plurality of adhering elements, wherein the plurality of adhering elements is comprised in the plurality of game board surface portions, wherein the plurality of adhering elements is configured for attaching the plurality of game pieces on the plurality of game board surface portions in at least one of the plurality of first board positions and the plurality of board positions.

4. The game apparatus of claim 2, wherein the plurality of game pieces comprises a plurality of first adhering elements, wherein the plurality of first adhering elements is configured for attaching the plurality of game pieces to the plurality of game board surface portions in at least one of the plurality of first board positions and the plurality of board positions.

5. The game apparatus of claim 3, wherein the plurality of adhering elements is configured for removably attaching the plurality of game pieces on the plurality of game board surface portions in the at least one of the plurality of first board positions and the plurality of board positions.

6. The game apparatus of claim 3, wherein an adhering element of the plurality of adhering elements comprises a first adhering part and a second adhering part, wherein the first adhering part is comprised in a game board surface portion of the plurality of game board surface portions, wherein the second adhering part is comprised in a game piece of the plurality of game pieces, wherein the first adhering part and the second adhering part is configured to be detachably attached for detachably attaching the game piece to the game board surface portion.

7. The game apparatus of claim 2 further comprising:

a plurality of sensors disposed on the game board, wherein a sensor of the plurality of sensors is configured for generating sensor data based on a presence of a game piece of the plurality of game pieces on a game board surface portion of the plurality of game board surface portions;

a plurality of light emitting devices comprised in the plurality of game board surface portions, wherein the plurality of light emitting devices is electrically powered; and a processing device communicatively coupled with the plurality of sensors and the plurality of light emitting devices, wherein the processing device is configured for:

analyzing the sensor data;

identifying a light emitting device of the plurality of light emitting devices associated with the game board surface portion based on the analyzing; and generating a first command based on the identifying, wherein the light emitting device is configured for emitting light based on the first command.

8. The game apparatus of claim 7, wherein the plurality of game pieces comprises a plurality of first light emitting devices, wherein the plurality of first light emitting devices is electrically powered, wherein the plurality of sensors is configured for generating a plurality of first sensor data based on a plurality of relative presences of the plurality of game pieces on the plurality of game board surface portions, wherein the processing device is communicatively coupled with the plurality of first light emitting devices, wherein the processing device is further configured for:

analyzing the plurality of first sensor data;

identifying at least one first light emitting device comprised in at least one game piece of the plurality of game pieces; and generating a second command based on the identifying of the at least one first light emitting device, wherein the at least one first light emitting device is configured for emitting light based on the second command.

9. The game apparatus of claim 1, wherein the top game board surface of the game board is visually accessible to at least one user and the bottom game board surface of the game board is not visually accessible to the at least one user in a first board position of the plurality of first board positions from at least one user viewing position of the at least one user.

10. The game apparatus of claim 9 further comprising at least one reflective panel disposed parallel to the base member, wherein the at least one reflective panel is configured for providing a visual access of the bottom game board surface to the at least one user in the first board position from the at least one user viewing position, wherein the top game board surface and the bottom game board surface are simultaneously visually accessible to the at least one user based on the providing.

11. The game apparatus of claim 1, wherein the at least one support member is configured for receiving at least one external action on at least one support member portion of the at least one support member, wherein the extending of the at least one support member is based on the receiving of the at least one external action.

12. The game apparatus of claim 1, wherein the game board is configured for receiving at least one first external action on at least one game board portion of the game board, wherein the rotating of the game board is based on the receiving of the at least one first external action.

13. The game apparatus of claim 1, wherein the at least one support member is movably coupled with the base member using at least one moving mechanism, wherein the at least one support member is configured for moving between a plurality of support member positions in relation to the base member, wherein the extending of the at least one support member is based on the moving.

14. The game apparatus of claim 1 further comprising:

at least one input device configured for receiving at least one input action on at least one device portion of the at least one input device, wherein the at least one input device is configured for generating at least one input data based on the receiving of the at least one input action;

a processing device communicatively coupled with the at least one input device, wherein the processing device is configured for:

analyzing the at least one input data; and generating a command based on the analyzing; and at least one actuator operationally coupled with the at least one support member, wherein the at least one actuator is communicatively coupled with the processing device, wherein the at least one actuator is electrically powered, wherein the at least one actuator is configured for extending the at least one support member to the plurality of positions based on the command.

* * * * *